US007550242B2

(12) United States Patent
Nozaki et al.

(10) Patent No.: US 7,550,242 B2
(45) Date of Patent: Jun. 23, 2009

(54) TONER, TONER MANUFACTURING METHOD, DEVELOPER, IMAGE FORMING APPARATUS, AND PROCESS CARTRIDGE FOR THE IMAGE FORMING APPARATUS

(75) Inventors: Tsuyoshi Nozaki, Ikeda (JP); Chiyoshi Nozaki, Ohtsu (JP); Minoru Nakamura, Takarazuka (JP); Atsushi Yamamoto, Kawanishi (JP); Hideaki Yasunaga, Ibaraki (JP)

(73) Assignee: Ricoh Company Limited, Tokyo (JP)

( * ) Notice: Subject to any disclaimer, the term of this patent is extended or adjusted under 35 U.S.C. 154(b) by 382 days.

(21) Appl. No.: 11/372,186

(22) Filed: Mar. 10, 2006

(65) Prior Publication Data

US 2006/0204882 A1 Sep. 14, 2006

(30) Foreign Application Priority Data

Mar. 11, 2005 (JP) ..... 2005-069234
Sep. 16, 2005 (JP) ..... 2005-269690

(51) Int. Cl.
*G03G 9/093* (2006.01)

(52) U.S. Cl. ..... 430/110.2; 430/137.14; 399/159

(58) Field of Classification Search ..... 430/110.2, 430/137.14, 137.11; 399/159
See application file for complete search history.

(56) References Cited

U.S. PATENT DOCUMENTS 5,302,486 A * 4/1994 Patel et al. ..... 430/137.12
2005/0058927 A1* 3/2005 Mikuriya et al. ..... 430/110.2
2006/0166122 A1* 7/2006 Patel et al. ..... 430/110.2

FOREIGN PATENT DOCUMENTS

| | | |
|---|---|---|
| JP | 2000-292973 | 10/2000 |
| JP | 2000-292978 | 10/2000 |
| JP | 3195362 | 1/2001 |
| JP | 2001-305797 | 11/2001 |
| JP | 2002-091060 | 3/2002 |
| JP | 2002-116574 | 4/2002 |
| JP | 2003-280269 | 10/2003 |
| JP | 2004-184551 | 7/2004 |
| JP | 2004-333784 | 11/2004 |
| JP | 2005-077602 | 3/2005 |
| JP | 2005-091436 | 4/2005 |
| JP | 2005-341573 | 12/2005 |

OTHER PUBLICATIONS

U.S. Appl. No. 11/924,994, filed Oct. 26, 2007, Katoh, et al.

(Continued)

*Primary Examiner*—John L Goodrow
(74) *Attorney, Agent, or Firm*—Oblon, Spivak, McClelland, Maier & Neustadt, P.C.

(57) ABSTRACT

A toner having a core containing a colorant, a release agent and a binder resin (A), and a shell containing a binder resin (B), the shell overlying the core, wherein the binder resin (A) contains a resin having a polyester skeleton, the binder resin (B) contains a vinyl copolymer resin, and a weight ratio of the shell to the core is from 0.05 to 0.5, and wherein the toner has a volume average particle diameter of from 3 to 8 μm; a toner manufacturing method of such the toner can be used in an image forming apparatus and in a process cartridge.

26 Claims, 1 Drawing Sheet

OTHER PUBLICATIONS

U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/616,198, filed Dec. 26, 2006, Takuya Kadota, et al.
Patent Abstracts of Japan, English Abstract of 2003-280269 (Patent No. 3571703).
Patent Abstracts of Japan, English Abstract of 2004-184551.
Patent Abstracts of Japan, English Abstract of 2004-333784.
Patent Abstracts of Japan, English Abstract of JP 05-341573 (Patent No. 2961465).
Rips21.ricoh.co.jp/pv21/uspvlink.do, English Abstract of WO 9701131 A1 (3195362).
Patent Abstracts of Japan, English Abstract of 2000-292973.
Patent Abstracts of Japan, English Abstract of 2000-292978.
Patent Abstracts of Japan, English Abstract of 2001-305797.
Patent Abstracts of Japan, English Abstract of 2002-091060.
Patent Abstracts of Japan, English Abstract of 2002-116574.
Patent Abstracts of Japan, English Abstract of 2005-077602.
Patent Abstracts of Japan, English Abstract of 2005-091436.
U.S. Appl. No. 11/965,522, filed Dec. 27, 2007 Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, Mar. 12, 2008, Matsumoto, et al.
U.S. Appl. No. 12/048,689, filed Mar. 14, 2008, Kadota, et al.
U.S. Appl. No. 12/049,719, Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 11/624,453, Jan. 18, 2007, Yamamoto, et al.
U.S. Appl. No. 11/670,257, Feb. 1, 2007, Hagi, et al.
U.S. Appl. No. 11/674,244, Feb. 13, 2007, Nakamura, et al.
U.S. Appl. No. 11/624,525, filed Jan. 18, 2007, Yasunaga, et al.
U.S. Appl. No. 12/010,369, filed Jan. 24, 2008, Yasunaga, et al.
U.S. Appl. No. 11/685,313, filed Mar. 13, 2007, Nozaki, et al.
U.S. Appl. No. 11/685,890, filed Mar. 14, 2007, Nozaki, et al.
U.S. Appl. No. 11/687,431, filed Mar. 16, 2007, Matsumoto, et al.
U.S. Appl. No. 11/684,131, filed Mar. 9, 2007, Yasunaga, et al.
U.S. Appl. No. 11/686,801, filed Mar. 15, 2007, Kato, et al.
U.S. Appl. No. 11/681,530, filed Mar. 2, 2007, Kadota, et al.
U.S. Appl. No. 11/687,352, filed Mar. 16, 2007, Kurose, et al.
U.S. Appl. No. 11/696,879, filed Apr. 5, 2007, Yasunaga, et al.
U.S. Appl. No. 11/772,404, filed Jul. 2, 2007, Nakamura, et al.
U.S. Appl. No. 11/779,648, filed Jul. 18, 2007, Yamamoto, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 11/855,739, filed Sep. 14, 2007, Fuwa, et al.
U.S. Appl. No. 12/027,704, filed Feb. 7, 2008, Fuwa, et al.
U.S. Appl. No. 12/043,633, filed Mar. 6, 2008, Nakamura, et al.
U.S. Appl. No. 12/046,869, filed Mar. 12, 2008, Nozaki, et al.
U.S. Appl. No. 12/048,865, filed Mar. 14, 2008, Yasunaga, et al.
U.S. Appl. No. 12/172,378, filed Jul. 14, 2008, Yamamoto, et al.

* cited by examiner

TONER, TONER MANUFACTURING METHOD, DEVELOPER, IMAGE FORMING APPARATUS, AND PROCESS CARTRIDGE FOR THE IMAGE FORMING APPARATUS

BACKGROUND OF THE INVENTION

1. Field of the Invention

The present invention relates to a toner for use in an electrophotographic image forming apparatus. In addition, the present invention also relates to a toner manufacturing method; an image forming apparatus and a process cartridge using the toner.

2. Discussion of the Background

When a toner image formed by an electrophotographic image forming method is fixed, contact heat fixing methods such as a heat roller fixing method are typically used. A fixing device used for the heat roller fixing methods includes a heating roller and a pressing roller. A toner image formed on a recording material is fixed by passing through a nip formed between the heating roller and the pressing roller.

In contact heat fixing methods, because the surface of a heating member (such as the heating roller) directly contacts the toner image, a part of the toner is adhered to the heating member and then re-transferred to the following sheet of the recording material, resulting in occurrence of the offset problem.

In attempting to prevent occurrence of the offset problem, a technique in which a fixing oil such as a silicon oil is applied or penetrated to the heating roller and the pressing roller, is proposed. However, in order to downsize the device and lower the operation costs, oilless fixing devices without a fixing oil applying system or fixing devices applying a small amount of oil have been typically used. For these fixing devices, toners including a release agent serving as an offset inhibitor are used.

On the other hand, in heat fixing methods, the heating temperature is preferably as low as possible from the viewpoint of energy saving. However, a toner binder resin having too low thermal properties (such as low-temperature fixability) has poor thermostable preservability and causes a toner blocking problem. Polyester resins are preferably used as toner binder resins because of having both low-temperature fixability and thermostable preservability. This is because polyester resins have a relatively low viscosity and a high elasticity compared to vinyl copolymer resins.

However, when a toner including a large amount of release agent is manufactured by a conventional pulverization method, a major portion of release agent tends to exist on the surface of the resultant toner and causes a toner filming problem and a blocking problem. On the other hand, polymerization methods such as the suspension polymerization method in which reactive monomers are polymerized in an aqueous medium, and the emulsion aggregation method in which emulsion polymerization particles are aggregated in an aqueous medium, are known as toner manufacturing methods. Toners manufactured by these polymerization methods can include a release agent in an amount much greater than in the case of a pulverization method. Japanese Patent No. 3195362 discloses a suspension polymerization method in which the toner structure is controlled by further polymerizing monomers with granulated (polymerized) mother toner particles. Published unexamined Japanese Patent Application No. 2002-116574 (hereinafter referred to as JP-A) discloses an emulsion aggregation method in which the toner structure is controlled by further adding emulsion polymerization particles to granulated (polymerized) mother toner particles.

However, resins used for the suspension polymerization method and the emulsion aggregation method are vinyl resins because these reactions are performed in an aqueous medium. It is difficult to use polyester resins because the polyester is polymerized at a high temperature of about 200° C.

In emulsion aggregation methods, a metal salt is typically used as an aggregation agent. Therefore, the metal salt is incorporated in the resultant toner particles, but it is difficult to remove all of the incorporated metal salt in a washing process. Thereby, the resultant toner is largely affected by environmental conditions such as humidity.

As a toner manufacturing method using polyester resins, a solution suspension method in which a polymerized polymer, which is dissolved in an organic solvent to prepare a toner constituent solution, is emulsified to be granulated in an aqueous medium, is known. In this method, the molecular weight of the toner equals that of the binder resin. In order to control the thermal properties of the toner, a combination of a high-molecular-weight resin and a low-molecular-weight resin are typically used. However, when a high-molecular-weight resin is dissolved in a solvent, the viscosity of the solution is so large that the solution has poor granulation ability. In order to avoid such a problem, a method is used in which the molecular weight of the low-molecular-weight resin is set to be relatively high, instead of using a large amount of high-molecular-weight resin. In this case, the resultant toner has poor low-temperature fixability.

In attempting to solve such a problem caused by using high-molecular-weight resins, a toner manufacturing method using a modified polyester having a reactive group is proposed. In this method, the modified polyester having a reactive group is elongated or cross-linked after granulation of toner particles while controlling the molecular weight (i.e., thermal property.) However, the method has a drawback in that the toner structure cannot be sufficiently controlled and thereby colorants and release agents tend to exist on the surface of the toner.

JP-As 2000-292973 and 2000-292978 have disclosed toners having a particulate resin on the surface of the toner particles to improve hot offset resistance. However, the low-temperature fixability of the toner is insufficient. In addition, salting out fine particles on core particles takes a long time resulting in increase of the manufacturing cost.

SUMMARY OF THE INVENTION

Accordingly, an object of the present invention is to provide a toner having a good combination of the following properties:

(1) low-temperature fixability;
(2) thermostable preservability;
(3) hot offset resistance;
(4) structure controlling property;
(5) resistance to contaminating image forming members
(6) chargability
(7) environmental resistance Another object of the present invention is to provide a toner manufacturing method which can produce a toner having such properties as mentioned above.

Another object of the present invention is to provide an image forming apparatus and a process cartridge by which high quality images can be stably produced while the energy consumed in the fixing process can be reduced.

These and other objects of the present invention, either individually or in combinations thereof, as hereinafter will become more readily apparent can be attained by a toner including:

a core comprising a colorant, a release agent and a binder resin (A); and a shell comprising a binder resin (B), the shell overlying the core, wherein the binder resin (A) comprises a resin having a polyester skeleton, the binder resin (B) includes a vinyl copolymer resin, and a weight ratio of the shell to the core is from 0.05 to 0.5, and wherein the toner has a volume average particle diameter of from 3 to 8 μm.

In addition, the present invention provides a manufacturing method for producing the above toner; and an image forming apparatus and a process cartridge using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

The toner of the present invention comprises:

a core comprising a colorant, a release agent and a binder resin (A); and a shell comprising a binder resin (B), which is located overlying the core, wherein the binder resin (A) comprises a resin having a polyester skeleton, the binder resin (B) comprises a vinyl copolymer resin, and a weight ratio of the shell to the core is from 0.05 to 0.5, and wherein the toner has a volume average particle diameter of from 3 to 8 μm. Such the toner has both low-temperature fixability and thermostable preservability, while having hot offset resistance. In addition, the toner has good structure controlling property. Moreover, the toner has good resistance to contaminating image forming members, and has a good chargability.

Specific examples of resins having a polyester skeleton include polyester resins, hybrid resins having both a vinyl copolymer skeleton and a polyester skeleton in one molecule, etc. Among these resins, polyester resins are preferably used. Mixtures of resins can be used as well.

The toner manufacturing method of the present invention comprises:

dissolving or dispersing at least one resin having a polyester skeleton, at least one colorant and at least one release agent in an organic solvent to prepare a core constituent mixture liquid;

dispersing the core constituent mixture liquid in an aqueous medium to prepare a first dispersion comprising a core particles; and adding a second dispersion comprising a particulate vinyl copolymer resin to the first dispersion to adhere the particulate vinyl copolymer resin to the core particles, wherein the second dispersion is added to the first dispersion after the organic solvent is removed from the first dispersion, or the second dispersion is added to the first dispersion while the organic solvent is included in the first dispersion. The toner manufactured by the method mentioned above has both low-temperature fixability and thermostable preservability, while having hot offset resistance. In addition, the toner has good structure controlling property. Moreover, the toner has good resistance to contaminating image forming members, and has a good chargability.

Figure 1:
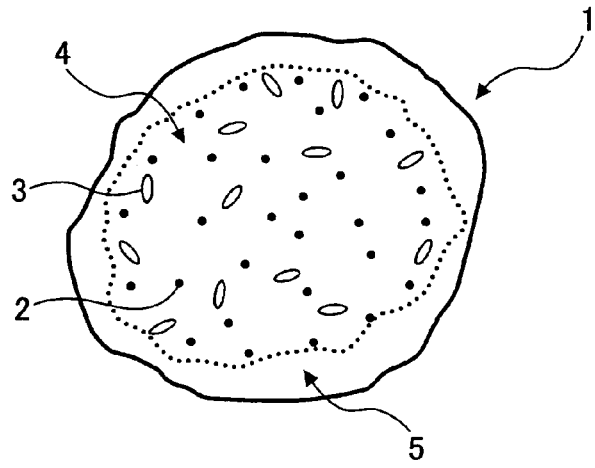
FIG. 1 is a schematic view illustrating a cross section of the toner of the present invention.

FIG. 1 is a schematic view illustrating a cross section of the toner of the present invention.

The toner 1 includes a core 4 including at least a colorant 2, a release agent 3 and a binder resin (A), and a shell 5 including a binder resin (B), which is located overlying the core. The binder resin (A) includes a polyester resin as a main component and the binder resin (B) includes a vinyl copolymer resin. Namely, the core serving as a main portion of the toner includes polyester resin which has advantages in terms of low-temperature fixability and thermostable preservability, and the shell serving as a surface portion of the toner includes vinyl copolymer resin which has an advantage in terms of chargability control.

The reasons of the vinyl copolymer resin having an advantage in terms of chargability control are as follows:

(1) Plural kinds of monomers can be mixed and polymerized. The selection of monomer is flexible, for example, polar groups such as carboxy groups and sulfonic groups can be easily incorporated in the polymer.

(2) In emulsion polymerization or suspension polymerization, the structure of the polymer can be controlled easily due to a polarity of the monomer. Functional groups originated in the monomer can efficiently exist on the surface of the toner.

Thus, the toner having good fixability (such as low-temperature fixability) and chargability (effects on developability and transferability) is obtained. A weight ratio of the shell to the core is preferably from 0.05 to 0.5, and more preferably from 0.07 to 0.4, and much more preferably from 0.1 to 0.3. The weight ratio of shell to core includes all values and subvalues therebetween, especially including 0.06, 0.07, 0.08, 0.09, 0.1, 0.2, 0.3 and 0.4. When the weight ratio is too small, chargability of the resultant toner deteriorates. In contrast, when the weight ratio is too large, an amount of the polyester resin serving as the binder resin (A) is too small, resulting in deterioration of fixability. The toner preferably has a volume average particle diameter of from 3 to 8 μm, and more preferably from 4 to 7 μm. The volume average particle diameter includes all values and subvalues therebetween, especially including 3.5, 4, 4.5, 5, 5.5, 6, 6.5, 7 and 7.5 μm. When the volume average particle diameter is too small, various problems tend to occur in each image forming process. When the volume average particle diameter is too large, the resolution of the produced image deteriorates.

The weight ratio of the particulate vinyl copolymer resin to the core particle on a solid basis is preferably from 3/97 to 30/70, and more preferably from 5/95 to 25/75, and much more preferably from 10/90 to 20/80. The weight ratio of the particulate vinyl copolymer resin to the core particle on a solid basis includes all values and subvalues therebetween, especially including 5/95, 10/90, 15/85, 20/80 and 25/75. When the weight ratio is too small, chargability of the resultant toner deteriorates. When the weight ratio is too large, the amount of the polyester resin serving as the binder resin (A) is too small, resulting in deterioration of fixability.

The toner of the present invention satisfies the following relationships:

$$RA(P)\times 0.5>PB(P) \text{ and } RA(W)\times 0.5>PB(W)$$

wherein RA(P) represents a weight ratio of the colorant included in the core to the core, RA(W) represents a weight ratio of the release agent included in the core to the core, RB(P) represents a weight ratio of the colorant included in the shell to the shell, RB(W) represents a weight ratio of the release agent included in the shell to the shell.

The toner preferably satisfies the following relationships:

$$RA(P)\times 0.2>PB(P) \text{ and } RA(W)\times 0.2>PB(W)$$

The toner more preferably satisfies the following relationships:

$$RA(P)\times 0.01>PB(P) \text{ and } RA(W)\times 0.01>PB(W)$$

Namely, the colorant and the release agent preferably do not exist near the surface of the toner. Such a toner does not cause a formation of release agent film on image forming members such as a photoreceptor. In addition, the toner has stable chargability and environmental resistance, therefore the charge difference between four-color toners can be minimized.

Polyester Resin

Any kinds of polyester resins can be used for the present invention. These can be used alone or in combination.

Specific examples of polyester resins for use in the present invention include polyesters formed by polycondensation reaction between a polyol (1) and a polycarboxylic acid (2)

<Polyol>

Specific examples of polyols (1) include alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicylic diols such as 1,4-cyclohexanedimethanol and hydrogenated bisphenol A; bisphenols such as bisphenol A, bisphenol F, bisphenol S, 4,4'-dihydroxybiphenyls (such as 3,3'-difluoro-4,4'-dihydroxybiphenyl), bis(hydroxyphenyl)alkanes (such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difuluoro-4-hydroxyphenyl)propane (also known as tetrafluoro bisphenol A), 2,2-bis(3-hydroxyphenyl)-1,1,1,3,3,3-hexafluoropropane), bis(4-hydroxyphenyl)ethers (such as bis(3-fluoro-4-hydroxyphenyl)ether); adducts of the above-mentioned alicyclic diol with an alkylene oxide such as ethylene oxide, propylene oxide and butylenes oxide; and adducts of the above mentioned bisphenol with an alkylene oxide such as ethylene oxide, propylene oxide and butylenes oxide.

In particular, an alkylene glycol having 2 to 12 carbon atoms and adducts of bisphenol with an alkylene oxide are preferably used, and a mixture thereof is more preferably used.

Specific examples of the polyols having three or more valences include multivalent aliphatic alcohols having three or more valences such as glycerin, trimethylolethane, trimethylolpropane, pentaerythritol and sorbitol; phenols having three or more valences such as trisphenol PA, phenolnovolak and cresolnovolak; and adducts of the above-mentioned polyphenol having three or more valences with an alkylene oxide.

These polyols can be used alone or in combination, but are not limited thereto.

<Polycarboxylic Acid>

Specific examples of the polycarboxylic acids (2) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid,. 3,3'-bis(trifluoromethyl)-4,4'-biphenyldicarboxylic acid, 2,2'-bis(trifluoromethyl)-3,3'-biphenyldicarboxylic acid, and hexafluoroisopropylidenediphthalic acid anhydride.

In particular, an alkenylene dicarboxylic acid having 4 to 20 carbon atoms and an aromatic dicarboxylic acid having 8 to 20 carbon atoms are preferably used.

Specific examples of the polycarboxylic acid having three or more valences include aromatic polycarboxylic acids having 9 to 20 carbon atoms such as trimellitic acid and pyromellitic acid.

The polycarboxylic acid can be formed from a reaction between one or more of the polyols and an anhydride or lower alkylester of one or more of the above-mentioned acids. Suitable lower alkyl esters include, but are not limited to, methyl esters, ethyl esters, and isopropyl esters.

These polycaboxylic acids can be used alone or in combination, but are not limited thereto.

<A Ratio Between Polyol and Polycarboxylic Acid>

A polyol (1) and a polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

<Molecular Weight of the Polyester Resin>

The polyester resin preferably has a weight-average molecular weight of from 1,000 to 30,000, preferably from 1,500 to 10,000, and more preferably from 2,000 to 8,000. The weight average molecular weight includes all values and subvalues therebetween, especially including 2000, 3000, 4000, 5000, 6000, 7000, 8000, 9000, 10000, 11000, 12000, 13000, 14000, 15000, 16000, 17000, 18000, 19000, 20000, 21000, 22000, 23000, 24000, 25000, 26000, 27000, 28000 and 29000. When the weight-average molecular weight is too small, thermostable preservability of the resultant toner deteriorates. When the weight-average molecular weight is too large, low-temperature fixability of the resultant toner deteriorates.

Vinyl Copolymer Resin

Any kinds of vinyl copolymer resins can be used for the present invention. These can be used alone or in combination.

The vinyl copolymer resin preferably has a weight-average molecular weight of not greater than 50,000, and more preferably not greater than 30,000. The weight average molecular weight includes all values and subvalues therebetween, especially including 1000, 2000, 3000, 4000, 5000, 6000, 7000, 8000, 9000, 10000, 11000, 12000, 13000, 14000, 15000, 16000, 17000, 18000, 19000, 20000, 21000, 22000, 23000, 24000, 25000, 26000, 27000, 28000, 29000, 30000, 35000, 40000 and 45000. When the weight-average molecular weight is too large, low-temperature fixability deteriorates.

The vinyl copolymer resin preferably has a glass transition temperature (Tg) of from 40 to 80° C., and more preferably from 50 to 70° C. The glass transition temperature includes all values and subvalues therebetween, especially including 45, 50, 55, 60, 65, 70 and 75° C. When Tg is too high, low-temperature fixability of the resultant toner deteriorates. When Tg is too low, the thermostable preservability of the resultant toner deteriorates.

The vinyl copolymer resin is formed by copolymerization of vinyl monomers. Specific examples of vinyl monomers are shown as follows:

(1) Vinyl Hydrocarbons:

aliphatic vinyl hydrocarbons: alkenes such as ethylene, propylene, butene, isobutylene, pentene, heptene, diisobutylene, octane, dodecene, octadecene, and other α-olefins except above-mentioned compounds; alkadienes such as butadiene, isoprene, 1,4-pentadiene, 1,6-hexadiene and 1,7-octadiene;

alicyclic vinyl hydrocarbons: monocycloalkenes, dicycloalkenes, monocycloalkadienes and dicycloalkadienes such as cyclohexene, (di)cyclopentadiene, vinylcyclohexene and ethylidenebicycloheptene; terpenes such as pinene, limonene and indene;

aromatic vinyl hydrocarbons: styrene; hydrocarbonic(alkyl, cycloalkyl, aralkyl and/or alkenyl) derivatives of the styrene such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene and trivinylbenzebe; vinylnaphthalene;

(2) Vinyl Monomers Including Carboxyl Group and These Salts:

unsaturated monocarboxylic acids and unsaturated dicarboxylic acids having 3 to 30 carbon atoms, anhydrides of these carboxylic acids and monoalkylesters (having 1 to 24 carbon atoms) of these carboxylic acids such as methacrylic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate and cinnamic acid;

(3) Vinyl Monomers Including Sulfonic Group, Vinyl Monoesters of Sulfic Acid and These Salts:

alkene sulfonic acids having 2 to 14 carbon atoms such as vinyl sulfonic acid, (meth)allyl sulfonic acid, methyl vinyl sulfonic acid, and styrene sulfonic acid; alkyl derivatives of these compounds having 2 to 24 carbon atoms such as α-methylstyrene sulfonic acid; sulfo(hydroxy)alkyl(meth) acrylates or (meth)acrylamides such as sulfopropyl(meth) acrylate, 2-hydroxy-3-(meth)acryloxypropyl suifonic acid, 2-(meth)acryloylamino-2,2-dimethylethane sulfonic acid, 2-(meth)acryloyloxyethane sulfonic acid, 3-(meth) acryloyloxy-2-hydroxypropane sulfonic acid, 2-(meth) acrylamide-2-methylpropane sulfonic acid, 3-(meth)acrylamide-2-hydroxypropane sulfonic acid, alkyl(having 3 to 18 carbon atoms)allylsulfo succinic acid, sulfic acid ester of poly(n is 2 to 30)oxyalkylene(ethylene, propylene, butylene and their mono, random and block copolymers)mono (meth)acrylate (such as sulfic acid ester of of poly(n is 5 to 15)oxypropylenemonomethacrylate); sulfic acid esters of polyoxyethylene polycyclic phenylether;

(4) Vinyl Monomers Including Phosphate Group and These Salts:

(meth)acryloyloxyalkyl phosphoric acid monoesters such as 2-hydroxyethyl(meth)acryloyl phosphate, phenyl-2-acryloyloxyethyl phosphate;

(meth)acryloyloxyalkyl (having 1 to 24 carbon atoms) phosphonic acids such as 2-acryloyloxyethyl phosphonic acid.

Specific examples of above-mentioned salts of monomers shown in (2) to (4) include alkali metal salts (such as sodium salts, potassium salts), alkaline-earth metal salts (such as calcium salts, magnesium salts), ammonium salts, amine salts and quaternary ammonium salts.

(5) Vinyl Monomers Including Hydroxyl Group:

hydroxystyrene, N-methylol(meth)acrylamide, hydroxyethyl(meth)acrylate, hydroxypropyl(meth)acrylate, polyethyleneglycol mono(meth)acrylate, (meth)allylalcohol, crotyl alcohol, isocrotyl aicohol, 1-butene-3-ol, 2-butene-1-ol, 2-butene-1,4-diol, propargyl alcohol, 2-hydroxyethyl propenyl ether, sucrose allyl ether, etc.;

(6) Vinyl Monomers Including Nitrogen:

vinyl monomers including amino group: aminoethyl(meth) acrylate, dimethylaminoethyl(meth)acrylate, diethylaminoethyl(meth)acrylate, t-butylaminoethyl(meth)acrylate, N-aminoethyl(meth)acrylamide, (meth)acrylamine, morpholinoethyl(meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and these salts, etc.;

vinyl monomers including amide group: (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, N-vinylpyrrolidone, etc.;

vinyl monomers including nitrile group: (meth)acrylonitrile, cyanostyrene, cyanoacrylate, etc.;

vinyl monomers including quaternary ammonium cation group: quaternary compounds of vinyl monomers including tertiary amine group (produced by using quaternate agent such as methyl chloride, dimethyl sulfonic acid, benzyl chloride, and dimethyl carbonate) such as dimethylaminoethyl(meth)acrylate, diethylaminoethyl(meth)acrylate, dimethylaminoethyl(meth)acrylamide, diethylaminoethyl(meth)acrylamide, and diallylamine; vinyl monomers including nitro group: nitrostyrene, etc.;

(7) Vinyl Monomers Including Epoxy Group:

glycidyl(meth)acrylate, tetrahydrofurfuryl(meth)acrylate, p-vinylphenylphenyloxide, etc.;

(8) Vinylesters, Vinyl(thio)ethers, Vinylketones, vinylsulfones:

vinylesters such as vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxyacrylate, alkyl(meth)acrylates including alkyl group having 1 to 50 carbon atoms (such as methyl (meth)acrylate, ethyl(meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate and eicocyl(meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane and tetramethallyloxyethane), vinyl monomers including polyalkyleneglycol chain (such as polyethyleneglycol (molecular weight of 300) mono(meth)acrylate, polypropyleneglycol (molecular weight of 500) monoacrylate, adduct of methy alcohol (meth)acrylate with 10 mols of ethyleneoxide, and adduct of lauryl alcohol (meth)acrylate with 30 mols of ethyleneoxide), and poly(meth)acrylates ((meth)acrylates of polyalcohols such as ethyleneglycol di(meth)acrylate, propyleneglycol di(meth)acrylate, neopentylglycol di(meth)acrylate, trimethylolpropane tri (meth)acrylate, and polyethyleneglycol di(meth)acrylate); vinyl(thio)ethers such as vinylmethylether, vinylethylether, vinylpropylether, vinylbutylether, vinyl-2-ethylhexylether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, and phenoxystyrene;

vinylketones such as vinyl methyl ketone, vinyl ethyl ketone, and vinyl phenyl ketone;

vinylsulfones such as divinylsulfide, p-vinyldiphenylsulfide, vinylethylsulfide, vinylethylsulufone, divinylsulfone, and divinylsulfoxide;

(9) Another Vinyl Monomers:

isocyanate ethyl(meth)acrylate, m-isopropenyl-α,α-dimethylbenzylisocyanate, etc.;

(10) Vinyl Monomers Including Fluorine:

4-fluorostyrene, 2,3,5,6-tetrafluorostyrene, pentafluorophenyl(meth)acrylate, pentafluorobenzyl(meth)acrylate, perfluorohexyl(meth)acrylate, perfluorocyclohexylmethyl (meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl(meta)acrylate, 1H,1H,7H-dodecafluoroheptyl(meth)acrylate, perfluorooctyl(meth) acrylate, 2-perfluorooctylethyl(meth)acrylate, heptadecafuluorodecyl(meth)acrylate, trihydroperfluoroundecyl(meth)acrylate, perfluoronorbornylmethyl (meth)acrylate, 1H-perfluoroisobornyl(meth)acrylate, 2-(N-butylperfluorooctanesulfoneamide)ethyl(meth) acrylate, 2-(N-ethylperfluorooctanesulfoneamide)ethyl (meth)acrylate, derivatives of α-fluoroacrylic acid;

bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate;

vinylheptafluoro butyrate, vinylperfluoro heptanoate, vinylperfluoro nonanoate, vinylperfluoro octanoate, etc.

Specific examples of copolymers of vinyl monomers include copolymers including two or more above-mentioned vinyl monomers shown in (1) to (10) in an arbitary ratio such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, styrene-styrene sulfonic acid-(meth)acrylate copolymer, etc.

Particulate Vinyl Copolymer Resin

For use in the toner manufacturing method of the present invention, the vinyl copolymer resin mentioned above is preferably used as an aqueous dispersion of a particulate vinyl copolymer resin. In general, the particulate vinyl copolymer resin is easily manufactured by emulsion polymerization method. It is preferable that the binder resin (B) of the toner of the present invention is formed by aggregation and/or fusion of the particulate vinyl copolymer resin. This is because the shell formed by aggregation and/or fusion of the particulate resin can cover the core of the toner sufficiently. Specifically, when the shell is formed by fusion of the particulate resin, the shell covers the core much sufficiently, and the toner surface is smooth and uniform, resulting in stability of charge quantity distribution and improvement of transferability.

Modified Polyester Resin

The binder resin (A) of the present invention can include a modified polyester resin including a urethane and/or a urea group, to control the viscoelasticity of the resultant toner for the purpose of improving the hot offset resistance. The weight ratio of the polyester resin including a urethane and/or a urea group to the binder resin (A) is preferably not greater than 20%, and more preferably not greater than 15%, and much more preferably not greater than 10%. When the ratio is too large, low-temperature fixability deteriorates. The polyester resin including a urethane and/or a urea group can be mixed directly with the binder resin (A). However, from the viewpoint of the manufacturability of the toner, it is preferable that a relatively low-molecular-weight modified polyester including an isocyanate group at its ends (hereinafter referred to as a prepolymer) and an amine capable of reacting with the prepolymer are mixed with the binder resin (A) so that an elongation and/or a crosslinking reaction of the prepolymer and the amine is performed while or after a granulation, resulting in formation of the polyester resin including a urethane and/or urea group. In this case, a relatively high-molecular-weight modified polyester for control of the viscoelasticity can be included easily in the core.

<Prepolymer>

The prepolymer including an isocyanate group is formed by a reaction between a polyisocyanate (3) and a polyester having an active hydrogen group which is formed by the polycondensat ion reaction between the polyol (1) and the polycarboxylic acid (2). Specific examples of the active hydrogen groups included in the polyesters include hydroxyl group (alcoholic hydroxyl group and phenolic hydroxyl group), amino group, carboxyl group, mercapto group, etc. Among these, alcoholic hydroxyl group is preferably selected.

<Polyisocyanate>

Specific examples of the polyisocyanates (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenediisocyanate and diphenylmethanediisocyanate; aromatic aliphatic diisocyanates such as α, α, α', α',-tetramethylxylylenediisocyanate; isocyanurates; the above-mentioned polyisocyanates blocked with phenol derivatives, oxime and caprolactam; and their combinations.

<A Ratio Between Isocyanate Group and Hydroxyl Group>

A polyisocyanate (3) is mixed with a polyester such that the equivalent ratio ([NCO]/[OH]) between an isocyanate group [NCO] and polyester having a hydroxyl group [OH] is typically from 5/1 to 1/1, preferably from4/1 to 1.2/1 and more preferably from 2.5/1 to 1.5/1. The equivalent ratio ([NCO]/[OH]) includes all values and subvalues therebetween, especially including 4.5/1, 4/1, 3.5/1, 3/1, 2.5/1, 2/1 and 1.5/1. When the ratio [NCO]/[OH] is too large, low-temperature fixability of the resultant toner deteriorates. When the ratio [NCO]/[OH] is too small, the urea content in the resultant modified polyester decreases and the hot offset resistance of the resultant toner deteriorates. The content of the constitutional unit obtained from a polyisocyanate (3) in the polyester prepolymer (having a polyisocyanate group at its ends) is from 0.5 to 40% by weight, preferably from 1 to 30% by weight, and more preferably from 2 to 20% by weight. The content of the constitutional unit obtained from a polyisocyanate includes all values and subvalues therebetween, especially including 1, 5, 10, 15, 20, 25, 30 and 35% by weight. When the content is too small, the hot offset resistance of the resultant toner deteriorates. In contrast, when the content is too large, low-temperature fixability of the resultant toner deteriorates.

<Number of Isocyanate Groups in Prepolymer>

The number of the isocyanate groups included in a molecule of the polyester prepolymer is at least 1, preferably from 1.5 to 3 on average, and more preferably from 1.8 to 2.5 on average. When the number of isocyanate groups is less than 1 per molecule, the molecular weight of the modified polyester after an elongation and/or a crosslinking reaction decreases and the hot offset resistance of the resultant toner deteriorates.

<Elongation and/or Crosslinking Agent>

In the present invention, amines can be used as an elongation and/or a crosslinking agents. Specific examples of the amines include diamines, polyamines having three or more amino groups, amino alcohols, amino mercaptans, amino acids and blocked amines in which the amino groups in the above-mentioned amines are blocked.

Specific examples of the diamines include aromatic diamines such as phenylene diamine, diethyltoluene diamine and 4,4'-diaminodiphenyl methane, tetrafluoro-p-xylylene diamine, and tetrafluoro-p-phenylene diamine; alicyclic diamines such as 4,4'-diamino-3,3'-dimethyldicyclohexyl methane, diaminocyclohexane and isophorondiamine; aliphatic diamines such as ethylene diamine, tetrametylene diamine and hexamethylene diamine, dodecafluorohexylene diamine, and tetracosafluorododecylene diamine.

Specific examples of the polyamines having three or more amino groups include diethylene triamine, triethylene tetramine.

Specific examples of the amino alcohols include ethanol amine and hydroxyethyl aniline.

Specific examples of the amino mercaptan include aminoethyl mercaptan and aminopropyl mercaptan.

Specific examples of the amino acids include amino propionic acid and amino caproic acid.

Specific examples of the blocked amines include ketimine compounds which are prepared by reacting one of the above-mentioned amines with a ketone such as acetone, methyl ethyl ketone and methyl isobutyl ketone; oxazoline compounds, etc.

<Molecular Weight Control Agent>

The molecular weight of the modified polyester can optionally be controlled using an molecular weight control agent, if desired. Specific examples of the molecular weight control agent include monoamines such as diethyl amine, dibutyl amine, butyl amine and lauryl amine; and blocked amines, i.e., ketimine compounds prepared by blocking the monoamines mentioned above.

<A Ratio Between Amino Group and Isocyanate Group>

The mixing ratio (i.e., a ratio [NCO]/[NHx]) of the content of the prepolymer having an isocyanate group to the amine is from 1/2to 2/1, preferably from 1/1.5 to 1.5/1 and more preferably from 1/1.2 to 1.2/1. The mixing ratio includes all values and subvalues therebetween, especially including 1.2/1.8, 1.4/1.6, 1.6/1.4 and 1.8/1.2. When the mixing ratio is too large or too small, the molecular weight of the urea-modified polyester decreases, resulting in deterioration of hot offset resistance of resultant toner.

Colorant

Specific examples of colorants for use in the present invention include any known dyes and pigments such as carbon black, Nigrosine dyes, black iron oxide, NAPHTHOL YELLOW S, HANSA YELLOW (10G, 5G, G, GR, A, RN and R), Cadmium yellow, yellow iron oxide, loess, chrome yellow, Titan yellow, polyazo yellow, Oil yellow, Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL,. isoindolinone yellow, red iron oxide, red lead, orange lead, cadmium red, cadmium mercury red, antimony orange, Permanent Red (4R, F2R, F4R, FRL, FRLL, F4RH, F5R), Para Red, Fire Red, p-chloro-o-nitroaniline red, Lithol Fast Scarlet G, Brilliant Fast Scarlet, Brilliant Carmine 6B, Pigment Scarlet 3B, Bordeaux (5B and 10B), Toluidine Maroon, PERMANENT BORDEAUX F2K, HELIO BORDEAUX BL, BON MAROON LIGHT, BON MAROON MEDIUM, Eosin Lake, Rhodamine Lake B, Phodamine Lake Y, Arizaline Lake, Thioindigo Red B, Thioindigo Maroon, Oil Red, Quinacridone Red, Pyrazolone Red, polyazo red, Chrome Vermilion, Benzidine Orange, perynone orange, Oil orange, cobalt blue, cerulean blue, ALkali Blue Lake, Peacock Blue Lake, Victoria Blue Lake, metal-free Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome green, zinc green,chromium oxide, viridian, emerald green, Pigment Green B, Naphthol Green B, Green Gold, Acid Green Lake, Malachite Green Lake, Phthalocyanine Green, Anthraquione Green, titanium oxide, zinc oxide, lithopone and like. These materials are used alone or in combination. The toner particles preferably include the colorant in an amount of from 1 to 15% by weight, and more preferably from 3 to 10% by weight. The amount of colorant includes all values and subvalues therebetween, especially including 2, 3, 4, 5, 6, 7, 8, 9, 10, 11, 12, 13 and 14% by weight.

Master Batch of the Colorant

The colorant for use in the present invention can be combined with a resin to be used as a master batch. Specific examples of the resin for use in the master batch include modified and unmodified polyester resins mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthaline copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-methyl α-chloro methacrylate copolymers, styrene-acrylnitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybuthylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins are used alone or in combination.

Master Batch Manufacturing Method

The master batch can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method can be preferably used in which an aqueous paste including a colorant and water is mixed with a resin dissolved in an organic solvent and kneaded so that the colorant is transferred to the resin side (i.e., the oil phase), and then the organic solvent (and water, if desired) is removed. This is preferred because the resultant wet cake can be used as it is without being dried. When performing the mixing and kneading process, dispersing devices capable of applying a high shearing force such as a three roll mill can be preferably used.

Release Agent

Known waxes can be used for the toner for use in the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerine tribehenate and 1,18-octadecanediol distearate); polyalkanol esters (e.g., tristearyl trimelliate and distearyl maleate); polyalkanoic acid amides (e.g., ethylenediamine dobehenyl amide); polyalkylamides (e.g., trimellitic acid tristearylamide); and dialkyl ketones (e.g., distearyl ketone). Among these waxes having a carbonyl group, polyalkanoic acid esters are preferably used.

The content of a wax in the toner of the present invention is preferably from 5 to 15% by weight. The amount of wax includes all values and subvalues therebetween, especially including 6, 7, 8, 9, 10, 11, 12, 13 and 14% by weight. When the wax content is too small, releasability and hot offset resistance of the resultant toner deteriorates. In contrast, when the wax content is too large, the wax tends to bleed out from the toner particles when the toner is agitated in a developing process so that the wax adheres to a toner control member or a photoreceptor, resulting in occurrence of the image noise. This is because the wax melts at low temperature so that the wax easily influenced by a thermal energy and a mechanical energy. When the endothermic peak (i.e., melting point) of the wax measured by the differential scanning calorimeter (DSC) is from 65 to 115° C., the resultant toner has low-temperature fixability. The melting point includes all values and subvalues therebetween, especially including 70, 75, 80, 85, 90, 95, 100, 105 and 110° C. When the melting point is too low, fluidity of the resultant toner deteriorates. When the melting point is too high, fixability of the resultant toner deteriorates.

Charge Controlling Agent

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of marketed products of the charge controlling agents include BONTRON 03 (Nigrosine dyes), BONTRON P-51 (quanternary ammonium salt), BONTRON S-34 (metal-containing azo dye), E-82 (metal complex of oxynaphthoic acid), E-84 (metal complex of salicylic acid) and E-89 (phenolic condensation product), which are manufactured by Orient Chemical Industries Co., Ltd.; COPYCHARGE PSYVP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901 and LR-147 (boron complex), which are manufactured by Japan Carlit Co., Ltd.; copper phthalocyanine, perylene, quinacridone, azo pigments and polymers having a functional group such as sulfonate group, a carboxyl group, a quaternary ammonium group, etc.

External Additive

<Inorganic Particles>

Toner particles are preferably mixed with an external additive to improve fluidity, developability and chargeability of the toner. Inorganic fine particles are typically used as the external additive. Inorganic particulate materials having a primary particle diameter of from 5 nm to 2 μm, and preferably from 5 nm to 500 nm, are preferably used. The primary particle diameter includes all values and subvalues therebetween, especially including 10, 20, 30, 40, 50, 100, 200, 300, 400, 500, 600, 700, 800, 900 nm, 1 μm, 1.1, 1.2, 1.3, 1.4, 1.5, 1.6, 1.7, 1.8 and 1.9 μm. The surface area of the inorganic particulate materials is preferably from 20 to 500 $m^2/g$ when measured by a BET method. The BET surface area includes all values and subvalues therebetween, especially including 50, 100, 150, 200, 250, 300, 350, 400, 450 $m^2/g$. The content of the inorganic particulate material is preferably from 0.01% to 5.0% by weight, and more preferably from 0.01% to 2.0% by weight, based on the total weight of the toner. The content of the inorganic particulate material includes all values and subvalues therebetween, especially including 0.05, 0.1, 0.5, 1, 1.5, 2, 2.5, 3, 3.5, 4 and 4.5% by weight. Specific examples of such inorganic particulate materials include silica, alumina, titanium oxide, barium titanate, magnesium titanate, calcium titanate, strontiumtitanate, zincoxide, tinoxide, quartzsand, clay, mica, sand-lime, diatomearth, chromiumoxide, ceriumoxide, red iron oxide, antimony trioxide, magnesium oxide, zirconium oxide, barium sulfate, barium carbonate, calcium carbonate, silicon carbide, silicon nitride, etc.

<Polymer Particles>

Particles of a polymers such as polystyrene, polymethacrylates, and polyacrylate copolymers, which are prepared by a polymerization methods such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

<Hydrophobizing of External Additive>

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

<Cleanability Improving Agent>

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agents include fatty acids and their metal salts such as stearic acid, zinc stearate, and calcium stearate; and particulate polymers such as polymethylmethacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent. The volume average particle diameter includes all values and subvalues therebetween, especially including 0.05, 0.1, 0.2, 0.4, 0.6 and 0.8 μm.

Method for Manufacturing the Toner

Next, the method for manufacturing the toner for use in the present invention will be explained. The toner is preferably prepared by the following method, but is not limited thereto.

The method for manufacturing the toner of the present invention comprises at least:

dissolving or dispersing at least one resin having a polyester skeleton, at least one colorant and at least one release agent in an organic solvent to prepare a core constituent mixture liquid;

dispersing the core constituent mixture liquid in an aqueous medium to prepare a first dispersion comprising core particles; and adding a second dispersion comprising a particulate vinyl copolymer resin to the first dispersion to adhere the particulate vinyl copolymer resin to the core particles.

Preparation of Core Particle

<Organic Solvent>

Volatile solvents having a boiling point of lower than 100° C. are preferably used so as to be easily removed after the granulating process. Specific examples of the volatile solvents include toluene, xylene, benzene, carbon tetrachloride, methylenechloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobuthyl ketone. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used. The toner constituents, i.e., the polyester resin, the colorant and the release agent can be dissolved or dispersed simultaneously, however, these are dissolved or dispersed respectively in general. The solvent used in the respective dissolution or dispersion liquid can be same or different, but it is preferable to use same solvent in each dissolution or dispersion liquid so as to be easily removed.

<Dissolution or Dispersion of Polyester Resin>

The dissolution or dispersion liquid of the polyester resin preferably has a resin content of from 40 to 80%. The resin content includes all values and subvalues therebetween, especially including 45, 50, 55, 60, 65, 70 and 75% by weight. When the resin content is too high, dissolution or dispersion cannot be well performed because of the high viscosity of the solution. When the modified polyester resin having an isocyanate group at its ends (i.e., prepolymer) is mixed with the polyester resin, these can be dissolved or dispersed simultaneously or respectively. However, it is preferable that the prepolymer and the polyester resin are dissolved or dispersed respectively because solubility and viscosity of each material is different.

<Dissolution or Dispersion of Colorant>

The colorant can be dissolved or dispersed in the solvent alone, or with the polyester resin, optionally with a dispersibility improving agent and another polyester resin. In addition, the master batch of the colorant mentioned above can be used.

<Dissolution or Dispersion of Release Agent>

When a wax insoluble in the organic solvent is used as a release agent, the wax dispersion is prepared by typical methods. Namely, the mixture of the organic solvent and the wax is subjected to a dispersion treatment using a bead mill. In this case, it is preferable that the mixture is once heated to the melting point of the wax followed by cooling with an agitation, before being subjected to the dispersion treatment using a bead mill. This is because the dispersion time can be shortened. The waxes can be used alone or in combination, and optionally mixed with a dispersibility improving agent and another polyester resin.

<Aqueous Medium>

Suitable aqueous media include water. In addition, other solvents which can be mixed with water can be added to water. Specific examples of such solvents include alcohols such as methanol, isopropanol and ethylene glycol; dimethylformamide, tetrahydrofuran, cellosolves such as methyl cellosolve, lower ketones such as acetone and methyl ethyl ketone, etc. The content of the aqueous medium to 100 parts by weight of the toner constituent mixture liquid is typically from 50 to 2,000 parts by weight, and preferably from 100 to 1,000 parts by weight. The content of the aqueous medium includes all values and subvalues therebetween, especially including 100, 200, 300, 400, 500, 600, 700, 800, 900, 1000, 1100, 1200, 1300, 1400, 1500, 1600, 1700, 1800 and 1900 parts by weight. When the content is less than 50 parts by weight, the particulate organic material tends not to be well dispersed, and thereby a toner having a desired particle diameter cannot be prepared. In contrast, when the content is greater than 2,000 parts by weight, the production costs increase.

<Inorganic Dispersant and Particulate Resin>

The aqueous medium optionally includes an inorganic dispersant or a particulate resin. When an inorganic dispersant or a particulate resin is used, the resultant particles have a sharp particle diameter distribution and good dispersion stability. Specific examples of the inorganic dispersants include tricalcium phosphate, calcium carbonate, titanium oxide, colloidal silica, hydroxyapatite, etc. Any resins capable of formation of an aqueous dispersion thereof can be used for the particulate resin, whether the resin is thermoplastic resin or thermosetting resin. Specific examples of resins used for the particulate resins include vinyl resins, polyurethane resins, epoxy resins, polyester resins, polyamide resins, polyimide resins, silicon resins, phenol resins, melamin resins, urea resins, aniline resins, ionomer resins, polycarbonate resins, etc. These resins are used alone or in combination. Among these resins, vinyl resins, polyurethane resins, epoxy resins and polyester resins are preferably used because these resins can easily form aqueous dispersions of the particulate resins.

<Methods for Forming Aqueous Dispersion of Particulate Resin>

The methods for forming an aqueous dispersion of a particulate resin are as follows, but are not limited thereto:

(a) When the resin is a vinyl resin, an aqueous dispersion of a particulate resin is directly formed by polymerization reaction (such as suspension polymerization, emulsion polymerization, seed polymerization and dispersion polymerization) of monomers in an aqueous medium.

(b) When the resin is a polyaddition resin or a polycondensation resin such as polyester resin, polyurethane resin and epoxy resin, a precursor of the resin (such as monomer and oligomer) or a solvent solution of the precursor is dispersed in an aqueous medium in the presence of a suitable dispersant, followed by heating or adding a curing agent so that an aqueous dispersion of a particulate resin is formed.

(c) When the resin is a polyaddition resin or a polycondensation resin such as polyester resin, polyurethane resin and epoxy resin, a precursor of the resin (such as monomer and oligomer, preferably in liquid form, if not liquid, preferably liquefy by the application of heat) or a solvent solution of the precursor is phase-inversion emulsified by adding an aqueous medium after adding a suitable emulsifying agent thereto so that an aqueous dispersion of a particulate resin is formed.

(d) A resin formed by polymerization reaction (such as addition polymerization, ring-opening polymerization, condensation polymerization, addition condensation, etc.) is pulverized using a mechanical rotational type pulverizer or a jet type pulverizer, followed by a classification, to prepare a particulate resin. The particulate resin is dispersed in an aqueous medium in the presence of a suitable dispersant so that an aqueous dispersion of the particulate resin is formed.

(e) A resin formed by polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersant so that an aqueous dispersion of the particulate resin is formed.

(f) A resin formed by polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersant so that an aqueous dispersion of the particulate resin is formed.

(g) A resin formed by polymerization reaction (such as addition polymerization, ring-opening polymerization, condensation polymerization, addition condensation, etc.) is dissolved in a solvent, and then the resin solution is dispersed in an aqueous medium in the presence of a suitable dispersant, followed by removal of the solvent, so that an aqueous dispersion of a particulate resin is formed.

(h) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

<Surfactant>

When the toner constituent mixture liquid is emulsified and dispersed in an aqueous medium, surfactants are preferably used.

Specific examples of the surfactants include anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amine derivatives, polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl (C3-C4) sulfonate, sodium 3-{ω-fluoroalkanoyl (C6-C8)-N-ethylamino}-1-propanesulfonate, fluoroalkyl(C11-C20) carboxylic acids and their metal salts, perfluoroalkyl (C7-C13) carboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl (C6-C10)-N-ethylsulfonylglycin, monoperfluoroalkyl(C6-C16)ethylphosphates, etc. Specific examples of the cationic surfactants having a fluoroalkyl group include primary, secondary and tertiary aliphatic amines having a fluoroalkyl group, aliphatic quaternary salts such as perfluoroalkyl(C6-C10)sulfoneamidepropyltrimethylammonium salts, benzalkonium salts, benzetonium chloride, pyridinium salts, imidazolinium salts, etc.

<Polymeric Protection Colloid>

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine) In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid. When a dispersant such as calcium phosphate which can be dissolved in an acid or an alkali is used, the particles are preferably washed by a method in which the particles are washed with an acid such as hydrochloric acid to dissolve the dispersant, and then washed with water. In addition, such dispersants can also be removed from the resultant particles by a method using an enzyme. The dispersants can remain on the surface of the particles, however, it is preferable to be removed so that the resultant toner has a good chargability.

<Dispersing Machine>

As the dispersing machine, known mixers and dispersing machines such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. The rotation speed includes all values and subvalues therebetween, especially including 2000, 3000, 4000, 5000, 6000, 7000, 8000, 9000, 10000, 11000, 12000, 13000, 14000, 15000, 16000, 17000, 18000, 19000, 20000, 21000, 22000, 23000, 24000, 25000, 26000, 27000, 28000 and 29000 rpm. The temperature in the dispersing process is generally 0 to 150° C. (under pressure), and preferably from 20 to 80° C. The temperature includes all values and subvalues therebetween, especially including 10, 20, 30, 40, 50, 60, 70, 80, 90, 100, 110, 120, 130 and 140° C.

<Solvent Removal>

In order to remove the organic solvent from the thus prepared emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can also be used. Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

Adherence of Particulate Resin

Next, the process in which a particulate vinyl copolymer resin is adhered to core particles including a polyester resin (hereinafter referred to the adherence process) will be explained. The particulate vinyl copolymer resin (hereinafter referred to particulate resin) is preferably used as an aqueous dispersion thereof. The aqueous dispersion of the particulate resin can be easily prepared by typical emulsion polymerization methods and such the emulsion can be used for the adherence process without being treated. The aqueous dispersion of the particulate resin can optionally include surfactants in order to disperse the core particles and the particulate resin stably.

The aqueous dispersion of the particulate resin can be added to the dispersion of the core particles after the organic solvent is removed therefrom, or while the organic solvent is included therein. When the aqueous dispersion of the particulate resin is added to the dispersion of the core particles including the organic solvent, a ratio between the organic solvent and the aqueous medium can be controlled before the addition is performed. Moreover, hydrophilic solvent such as alcohol can be added to the dispersion of the core particles or the aqueous dispersion of the particulate resin in advance.

In the adherence process, the pH of the dispersion can be controlled by using sodium hydride or hydrochloric acid in order to efficiently adhere the particulate resin to the core particles. In addition, the aqueous dispersion of the particulate resin is preferably added to the dispersion of the core particles while being agitated or sheared. In order to uniformly adhere the particulate resin to the core particles, the aqueous dispersion of the particulate resin can be added gradually.

In order to transform the condition of the adhered particulate resin, the adhered particulate resin can be fused by the application of heat after the solvent is removed from the dispersion. When the particulate resin is fused, interfaces between each of the particles disappear. However, the uniformity of the surface and the circularity of the toner particles are controlled by controlling the heating temperature and the heating time. In addition, the aqueous dispersion of the particulate resin can be further added to the core particle dispersion after the solvent is removed, and then the particulate resin is adhered to the core particles by the application of heat. The covering condition and the surface property of the particulate resin are controlled by controlling the adding amount of the particulate resin in each process of two-step adherence process.

When the particulate resin is adhered to the core particles by the application of heat, a metal salt can be added as an aggregation agent in order to accelerate the adherence. An adding amount of metal salt and an adherence speed have a correlation in general. However, the metal salt tends to be incorporated in the toner particles in an aggregation process, and it is difficult to completely remove from the toner particles in a washing process. Therefore, if a large amount of the metal salt is added to the dispersion, a large amount of the metal salt remains in the toner particles, resulting in deterioration of chargability and environmental resistance of the resultant toner.

The aggregation agents for use in the present invention include metal salts consists of metals having 1 to 3 valences. Specific examples of monovalent metals included in the salts include lithium, potassium, sodium, etc. Specific examples of divalent metals included in the salts include calcium and magnesium. Specific examples of trivalent metals included in the salts include aluminum. Specific examples of anionic ions included in the salts include chloride ion, bromide ion, iodide ion, carbonate ion, and sulfate ion. The adherence can be accelerated by the application of heat. The heating temperature can be whether above or under the glass transition temperature (Tg) of the particulate resin. However, when the adherence process is performed at a temperature around or under Tg, there may be cases where the particulate resin does not well aggregate and/or fuse. Therefore, in this case, the adherence process may preferably performed again at higher temperature in order to accelerate aggregation and fusion of the particle resin so that the particulate resin sufficiently cover the core particles and the surface of the shell is uniformized. However, the uniformity of the surface and the circularity of the toner particles are controlled by controlling the heating temperature and the heating time. In addition, even after the adherence is performed by the application of heat, the particulate resin can be further fused by the application of heat.

Elongation and/or Crosslinking Reaction

In order that the resultant toner may include a modified polyester resin having a urethane and/or a urea group, a polyester resin having an isocyanate group at its ends (i.e., prepolymer) and an amine capable of reacting with the prepolymer is mixed. In this case, the amine can be mixed with the prepolymer in the oil phase liquid before the toner constituent mixture is dispersed in an aqueous medium, or the amine can be directly added to the aqueous medium. The reaction time is determined depending on the reactivity of the isocyanate of the prepolymer used with the amine used. However, the reaction time is typically from 10 minutes to 40 hours, and preferably from 1 to 24 hours. The reaction time includes all values and subvalues therebetween, especially including 20, 30, 40, 50 minutes, 1 hour, 2, 4, 6, 8, 10, 12, 14, 16, 18, 20, 22, 24, 26, 28, 30, 32, 34, 36, and 38 hours. The reaction temperature is typically from 0 to 150° C. and preferably from 20 to 98° C. The reaction temperature includes all values and subvalues therebetween, especially including 10, 20, 30, 40, 50, 60, 70, 80, 90, 100, 110, 120, 130 and 140° C. The reaction can be performed before the adherence process, or with the adherence process simultaneously. In addition, known catalysts can be added, if desired, when the reaction is performed.

Washing and Drying

The toner particles dispersed in an aqueous medium are washed and dried by known methods. Namely, the toner particles and the aqueous medium are separated by a centrifugal separator or a filter press (i.e., solid-liquid separation) so that the toner cake is prepared. Then the toner cake is redispersed in ion-exchange water at a temperature of from room temperature to 40° C., following by pH control using acids and bases, if desired. The solid-liquid separation is repeated several times to remove impurities and surfactants. After the washing treatment, the toner particles are subjected to a drying treatment using a flash dryer, a circulating dryer, a vacuum dryer, a vibrating fluid dryer, etc. The toner particles having a small particle diameter can be removed by a centrifugal separation in the liquid, or the toner particles can be subjected to a classification treatment using known classifier after the drying treatment.

External Treatment

The thus prepared toner particles are then mixed with one or more other particulate materials such as charge controlling agents, fluidizers optionally upon application of mechanical impact thereto to fix the particulate materials on the toner particles. Specific examples of such mechanical impact application methods include methods in which a mixture is mixed with a highly rotated blade and methods in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

Process Cartridge

Figure 2:
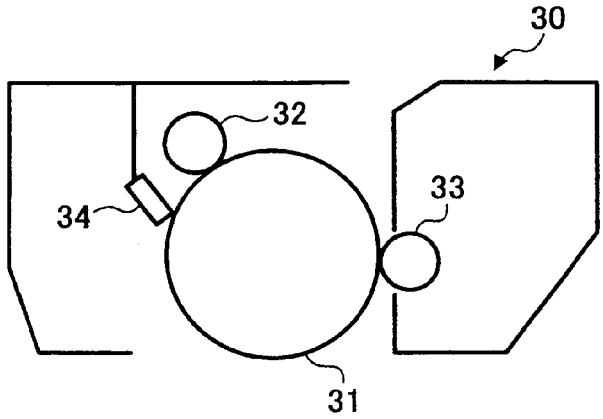
FIG. 2 is a schematic view illustrating an embodiment of the process cartridge of the present invention.

The toner of the present invention is used for an image forming apparatus including a process cartridge illustrated in FIG. 2. Such a process cartridge is detachable to an image forming apparatus such as copiers and printers.

The process cartridge 30 shown in FIG. 2 includes a photoreceptor 31, a charger 32, a developing device 33 and a cleaning device 34. The photoreceptor 31 rotates at a predetermined speed, and the surface thereof is charged by the charger 32 to reach to a positive or negative predetermined potential while rotating. Then the photoreceptor 31 is irradiated by an imagewise light emitted by a light irradiator such as a slit irradiator, a laser beam scanning irradiator, etc., to form an electrostatic latent image thereon. The electrostatic latent image is developed with a toner in the developing device 33, and then the toner image is transferred onto a transfer material which is timely fed from a feeding part to an area between the photoreceptor 31 and the transfer device in order to meet the toner images on the photoreceptor 31. The transfer material having the toner images thereon is separated form the photoreceptor 31 and transported to a fixing device so that the toner image is fixed and discharged from the image forming apparatus as a copying or a printing. After the toner image is transferred, a residual toner particles remaining on the photoreceptor are removed using the cleaning device 34, and then the photoreceptor is discharged. The photoreceptor 31 is used repeatedly.

Next, measurement and evaluation method of the toner will be explained. In the following explanation, the toner is analyzed and evaluated as a one-component developer, however, the toner of the present invention can be used as a two-component developer by mixing with a suitable external additive and a suitable carrier.

Measurement Method

<Particle Diameter>

The volume average particle diameter (Dv), number average particle diameter (Dn) and particle diameter distribution of a toner can be measured using an instrument COULTER COUNTER TA-II or COULETR MULTISIZER II from Coulter Electrons Inc.

The measuring method is as follows:

(1) 0.1 to 5 ml of a surfactant (preferably alkylbenzene sulfonate) is included as a dispersant in 100 to 150 ml of the electrolyte (i.e. 1% NaCl aqueous solution including a first grade sodium chloride such as ISOTON-II from Coulter Electrons Inc.);

(2) 2 to 20 mg of a toner is added in the electrolyte and the toner is dispersed by an ultrasonic dispersing machine for about 1 to 3 minutes to prepare a toner dispersion liquid;

(3) a volume and a number of the toner particles is measured by COULTER COUNTER TA-II or COULETR MULTISIZER II using an aperture of 100 μm to determine volume and number distribution thereof; and (4) the volume average particle diameter (Dv) and the weight average particle diameter (Dn) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, the particles having a particle diameter of from not less than 2.00 μm to less than 40.30 μm can be measured.

<Average Circularity>

The shape of a particle is preferably determined by an optical detection method such that an image of the particle is optically detected by a CCD camera and analyzed. A particle suspension is allowed to get through the image pickup detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The average circularity of the toner can be determined by a flow-type particle image analyzer, FPIA-2000 manufactured by Sysmex Corp. Specifically, the method is as follows:

(1) 0.1 g to 0.5 g of a sample to be measured is mixed with 100 to 150 ml of water from which solid impurities have been removed which includes 0.1 ml to 5.0 ml of a dispersant (i.e., a surfactant) such as alkylbenzene sulfonate;

(2) the mixture is dispersed using an ultrasonic dispersing machine for about 1 to 3 minutes to prepare a suspension including particles of 3,000 to 10,000 per 1 micro-liter of the suspension; and (3) the average circularity and circularity distribution of the sample in the suspension are determined by the measuring instrument mentioned above.

<Weight Average Molecular Weight>

The weight average molecular weight of the resins used in the present invention such as polyester resin and vinyl copolymer resin is determined by GPC (Gel Permeation Chromatography) method under the following conditions:

Instrument used: HLC-8220GPC (from Tosoh Corporation)

Column: TSKgel SuperHZM-M

Temperature: 40° C.

Solvent: THF (tetrahydrofuran)

Flow rate: 0.35 ml/min

Sample: 0.01 ml of a sample having a resin content of from 0.05 to 0.6% by weight is injected The molecular weight of the resin is determined while comparing the molecular distribution curve thereof with the working curve which is previously prepared using 10 polystyrene standard samples each having a single molecular weight peak. Each of standard polystyrene has a molecular weight of from $5.8\times10^2$ to $7.5\times10^6$.

<Glass Transition Temperature>

The glass transition temperature (Tg) of the resins used in the present invention such as polyester resin and vinyl copolymer resin is determined by a differential scanning calorimeter (such as DSC-6220R manufactured by Seiko Instrument Inc.). The measuring method is as follows:

(1) a resin is heated from room temperature to 150° C. at a temperature rising speed of 10° C./min;

(2) the resin is left for 10 minutes at 150° C.;

(3) the resin is cooled to room temperature and left for 10 minutes;

(4) the resin is heated again from room temperature to 150° C. at a temperature rising speed of 10° C./min; and (5) an endothermic curve of the resin is obtained.

Tg is determined by finding an intersection point of the endothermic curve and the line which is drawn between the middle of two baselines of the endothermic curve.

<Particle Diameter of Particulate Resin>

The particle diameter of the particulate resins used in the present invention such as vinyl copolymer resin is determined using instruments such as LA-920 (manufactured by Horiba Ltd.) and UPA-EX150 (manufactured by Nikkiso Co., Ltd.). An aqueous dispersion of a particulate resin can be used for measurement without any treatment.

<Fluorescent X-ray Intensity>

The fluorescent X-ray spectrum of the toner is measured by a fluorescent X-ray spectrometer. A toner sample is prepared as a pellet. A fluorescent X-ray intensity of peaks specific to Mg—Kα, Ca—Kα and Al—Kα are measured under the following conditions:

Instrument used: wavelength dispersive spectrometer ZSX-Primus (manufactured by Rigaku Corporation)

Detector: flow type counter

X-ray tube voltage/current: 5 kV/30 mA

Scanning time: 0.2 second

Evaluation

<Fixability>

A toner including external additives (developer) is set in an image forming apparatus IPSIO CX2500 manufactured by Ricoh Co., Ltd. Unfixed 36 mm-wide solid images (toner content: 9 g/m$^2$) are formed on the A4 size paper at a position of 3 mm behind the tip thereof while the A4 size paper is fed in the vertical direction. The unfixed images are fixed using a fixing device mentioned below at a temperature of from 130° C. to 190° C. in 10° C. steps so that a toner-fixable temperature range can be determined. In the toner-fixable temperature range, separation of the paper from the heating roller is well performed and offset problem does not occur. The paper used for the evaluation has a basic weight of 45 g/m$^2$ and has a cross direction. The paper is fed in the vertical direction in which a paper having a cross direction has a disadvantage for the paper separation. The feeding speed of the fixing device is 120 mm/sec.

Figure 3:
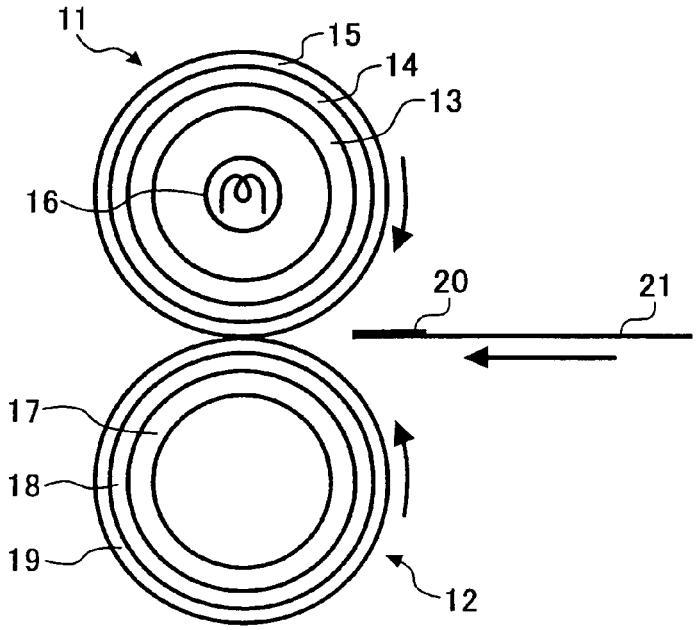
FIG. 3 is a schematic view illustrating an embodiment of the fixing device used in the evaluation of the toner of the present invention.

FIG. 3 is a schematic view illustrating a fixing device used for the evaluation of the toner of the present invention. The fixing device includes a soft roller having a fluorinated outermost layer. In particular, a heating roller 11 having an external diameter of 40 mm includes:

an aluminum cored bar 13;

an elastic layer 14 having a thickness of 1.5 mm and including a silicone rubber, which is located on the aluminum cored bar 13;

an outermost layer 15 including PFA (tetrafluoroethylene-perfluoro(alkylvinyl)ether copolymer), which is located on the elastic layer 14; and a heater 16 which is located inside the aluminum cored bar.

A pressing roller 12 having an external diameter of 40 mm includes:

an aluminum cored bar 17;

an elastic layer 18 having a thickness of 1.5 mm and including a silicone rubber, which is located on the aluminum cored bar 17;

an outermost layer 19 including PFA, which is located on the elastic layer 18.

A paper 21 having an unfixed image 20 thereon is fed in the direction indicated by an arrow.

The fixability is graded as follows:

○: a toner-fixable temperature range is not less than 50 degrees

Δ: a toner-fixable temperature range is not less than 30 degrees and less than 50 degrees x: a toner-fixable temperature range is less than 30 degrees <Toner Filming>

A toner including external additives (developer) is set in an image forming apparatus IPSIO CX2500 manufactured by Ricoh Co., Ltd. A running test in which 2,000 copies of chart having an image area proportion of 6% are continuously produced is performed at 23° C. and 45% RH. A photoreceptor and an intermediate transfer belt are visually observed to dertermine whether the toner film was formed thereon. The evaluation is performed as follows:

○: The toner film is not observed on both photoreceptor and intermediate transfer belt.

Δ: The toner film is observed on either photoreceptor or intermediate transfer belt, but not observed on the produced image. No problem in use.

x: The toner film is observed on either photoreceptor and/or intermediate transfer belt, and also observed on the produced image. Having problem in use.

<Durability>

A toner including external additives (developer) is set in an image forming apparatus IPSIO CX2500 manufactured by Ricoh Co., Ltd. A running test in which copies of chart having an image area proportion of 6% are continuously produced is performed at 23° C. and 45% RH. After 50 copies and 2,000 copies are produced, the developer existing on a developing roller is aspirated while copies having no image are produced. The difference between the charge after 50 copies and the charge after 2,000 copies are evaluated as follows:

○: the absolute value of the charge difference is not greater than 10 μC/g

Δ: the absolute value of the charge difference is greater than 10 μC/g and less than 15 μC/g x: the absolute value of the charge difference is not less than 15 μC/g <Thermostable Preservability>

A toner is preserved for 8 hours at 50° C., followed by sieving with a 42-mesh screen for 2 minutes. Thermostable preservability of a toner is evaluated by the residual ratio of the toner remaining on the screen. The residual ratio is evaluated as follows:

x: not less than 30%

Δ: not less than 20% and less than 30%

○: not less than 10% and less than 20%

◎: less than 10%

<Environmental Resistance>

A black toner including external additives (developer) is set in an image forming apparatus IPSIO CX2500 manufactured by Ricoh Co., Ltd. Running tests in which copies of chart having an image area proportion of 6% are continuously produced are performed under conditions of 28° C. and 80% RH, and conditions of 10° C. and 15% RH. After 50 copies and 2,000 copies are produced, the developer remaining on a photoreceptor is transferred to a tape while copies having no image are produced. The tape having residual toner thereon is attached to a white paper so as to be measured L* value by a calorimeter. The background fouling is evaluated as follows:

○: L* value is not less than 90 both after 50 copies and 2,000 copies

Δ: L* value is not less than 90 after 50 copies, not greater than 90 after 2,000 copies x: L* value is not greater than 90 both after 50 copies and 2,000 copies Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester

Preparation of Polyester (P-1)

The following components are fed in a reaction vessel equipped with a condenser, a stirrer and a nitrogen feed pipe.

| | |
|---|---|
| Ethylene oxide (2 mole) adduct of bisphenol A | 553 parts |
| Propylene oxide (2 mole) adduct of bisphenol A | 196 parts |
| Terephthalic acid | 220 parts |
| Adipic acid | 45 parts |
| Dibutyltin oxide | 2 parts |

The mixture is reacted for 8 hours at 230° C. under normal pressure.

Then the reaction is further continued for 5 hours under a reduced pressure of from 10 to 15 mmHg.

Further, 26 parts of trimellitic anhydride is fed to the container to be reacted with the reaction product for 2 hours at 180° C. Thus, a polyester (P-1) is prepared. The polyester (P-1) had a number average molecular weight (Mn) of 2,200, a weight average molecular weight (Mw) of 5,600, a glass transition temperature (Tg) of 43° C., and an acid value of 13 mgKOH/g.

Preparation of Polyester (P-2)

The following components are fed in a reaction vessel equipped with a condenser, a stirrer and a nitrogen feed pipe.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The mixture is reacted for 8 hours at 230° C. under normal pressure.

Then the reaction is further continued for 5 hours under a reduced pressure of from 10 to 15 mmHg.

Further, 44 parts of trimellitic anhydride is fed to the container to be reacted with the reaction product for 2 hours at 180° C. Thus, a polyester (P-2) is prepared. The polyester (P-2) had a number average molecular weight (Mn) of 2,500, a weight average molecular weight (Mw) of 6,700, a glass transition temperature (Tg) of 43° C., and an acid value of 25 mgKOH/g.

Preparation of Polyester (P-3)

The following components are fed in a reaction vessel equipped with a condenser, a stirrer and a nitrogen feed pipe.

| | |
|---|---|
| Ethylene oxide (2 mole) adduct of bisphenol A | 220 parts |
| Propylene oxide (3 mole) adduct of bisphenol A | 561 parts |

-continued

| | |
|---|---|
| Terephthalic acid | 218 parts |
| Adipic acid | 48 parts |
| Dibutyltin oxide | 2 parts |

The mixture is reacted for 8 hours at 230° C. under normal pressure.

Then the reaction is further continued for 5 hours under a reduced pressure of from 10 to 15 mmHg.

Further, 45 parts of trimellitic anhydride is fed to the container to be reacted with the reaction product for 2 hours at 180° C. Thus, a polyester. (P-3) is prepared. The polyester (P-3) had a weight average molecular weight (Mw) of 4,500, a glass transition temperature (Tg) of 50° C., and an acid value of 25 mgKOH/g.

Preparation of Polyester (P-4)

The procedure for preparation of the polyester (P-3) is repeated except components are changed as appropriate so as to prepare a polyester having different properties. Thus, a polyester (P-4) is prepared. The polyester (P-4) had a weight average molecular weight (Mw) of 6,000, a glass transition temperature (Tg) of 55° C.

Preparation of Particulate Vinyl Copolymer Resin

Preparation of Particulate Vinyl Copolymer Resin (V-1)

In a reaction vessel equipped with a condenser, a stirrer and a nitrogen feed pipe, 1.6 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto taking 90 minutes.

| | |
|---|---|
| Styrene monomer | 152 parts |
| Butyl acrylate | 38 parts |
| Methacrylic acid | 10 parts |
| n-Octyl mercaptan | 3.5 parts |

The mixture is kept for 60 minutes at 80° C., and then cooled down. Thus, an aqueous dispersion of a particulate vinyl copolymer resin (V-1) is prepared. An average particle diameter of the particulate vinyl copolymer resin (V-1) is 50 nm. A part of the dispersion is contained in a petri dish so that a dispersion medium (i.e., water) is removed and a solid material (i.e., particulate vinyl copolymer resin) could be obtained. The particulate vinyl copolymer resin (V-1) had a number average molecular weight (Mn) of 11,000, a weight average molecular weight (Mw) of 18,000, a glass transition temperature (Tg) of 65° C.

Preparation of Particulate Vinyl Copolymer Resin (V-2)

In a reaction vessel equipped with a condenser, a stirrer and a nitrogen feed pipe, 1.2 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto taking 90 minutes.

| | |
|---|---|
| Styrene monomer | 150 parts |
| Butyl acrylate | 30 parts |

-continued

| | |
|---|---|
| Methacrylic acid | 20 parts |
| n-Octyl mercaptan | 3 parts |

The mixture is kept for 60 minutes at 80° C., and then cooled down. Thus, an aqueous dispersion of a particulate vinyl copolymer resin (V-2) is prepared. An average particle diameter of the particulate vinyl copolymer resin (V-2) is 80 nm. Apart of the dispersion is contained in a petri dish so that a dispersion medium (i.e., water) is removed and a solid material (i.e., particulate vinyl copolymer resin) could be obtained. The particulate vinyl copolymer resin (V-2) had a number average molecular weight (Mn) of 14,000, a weight average molecular weight (Mw) of 29,000, a glass transition temperature (Tg) of 69° C.

Preparation of Particulate Vinyl Copolymer Resin (V-3)

In a reaction vessel equipped with a condenser, a stirrer and a nitrogen feed pipe, 1.6 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto taking 90 minutes.

| | |
|---|---|
| Styrene monomer | 154 parts |
| Butyl acrylate | 30 parts |
| Methacrylic acid | 16 parts |
| n-Octyl mercaptan | 3.4 parts |

The mixture is kept for 60 minutes at 80° C., and then cooled down. Thus, an aqueous dispersion of a particulate vinyl copolymer resin (V-3) is prepared. An average particle diameter of the particulate vinyl copolymer resin (V-3) is 90 nm. A part of the dispersion is contained in a petri dish so that a dispersion medium (i.e., water) is removed and a solid material (i.e., particulate vinyl copolymer resin) could be obtained. The particulate vinyl copolymer resin (V-3) had a number average molecular weight (Mn) of 13,000, a weight average molecular weight (Mw) of 24,000, a glass transition temperature (Tg) of 68° C.

Preparation of Particulate Vinyl Copolymer Resin (V-4)

In a reaction vessel equipped with a condenser, a stirrer and a nitrogen feed pipe, 0.7 parts of sodium dodecyl sulfate and 430 parts of ion-exchange water are contained and the mixture is heated to 80° C. Then a mixture of 2.3 parts of potassium persulfate and 90 parts of ion-exchange water are added thereto. After 15-minutes left, a mixture of the following components is gradually added thereto taking 90 minutes.

| | |
|---|---|
| Styrene monomer | 113 parts |
| Butyl acrylate | 43 parts |
| Methacrylic acid | 17.5 parts |
| n-Octyl mercaptan | 3.5 parts |

The mixture is kept for 60 minutes at 80° C., and then cooled down. Thus, an aqueous dispersion of a particulate vinyl copolymer resin (V-4) is prepared. An average particle diameter of the particulate vinyl copolymer resin (V-4) is 80 nm. A part of the dispersion is contained in a petri dish so that a dispersion medium (i.e., water) is removed and a solid material (i.e., particulate vinyl copolymer resin) could be obtained. The particulate vinyl copolymer resin (V-4) had a weight average molecular weight (Mw) of 11,000, a glass transition temperature (Tg) of 60° C.

Preparation of Particulate Vinyl Copolymer Resin (V-5)

The procedure for preparation of the particulate vinyl copolymer resin (V-4) is repeated except components are changed as appropriate so as to prepare a particulate vinyl copolymer resin having a different property. Thus, a vinyl copolymer resin (V-5) is prepared. The particulate vinyl copolymer resin (V-5) had a weight average molecular weight (Mw) of 29,000, a glass transition temperature (Tg) of 70° C.

The properties of each of the thus prepared resins are shown in Table 1.

TABLE 1

| Resin | Mw | Tg (° C.) |
|---|---|---|
| Polyester (P-1) | 5,600 | 43 |
| Polyester (P-2) | 6,700 | 43 |
| Polyester (P-3) | 4,500 | 50 |
| Polyester (P-4) | 6,000 | 55 |
| Particulate vinyl copolymer resin (V-1) | 18,000 | 65 |
| Particulate vinyl copolymer resin (V-2) | 29,000 | 69 |
| Particulate vinyl copolymer resin (V-3) | 24,000 | 68 |
| Particulate vinyl copolymer resin (V-4) | 11,000 | 60 |
| Particulate vinyl copolymer resin (V-5) | 29,000 | 70 |

Preparation of Prepolymer

The following components are fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture is reacted for 8 hours at 230° C. under normal pressure.

Then the reaction is further continued for 5 hours under a reduced pressure of from 10 to 15 mmHg. Thus, an intermediate polyester resin (1) is prepared. The intermediate polyester (1) had a number average molecular weight (Mn) of 2,100, a weight average molecular weight (Mw) of 9,500, a glass transition temperature (Tg) of 55° C., an acid value of 0.5 mgKOH/g and a hydroxyl value of 49 mgKOH/g.

In a reaction vessel equipped with a condenser, a stirrer and a nitrogen feed pipe, 411 parts of the intermediate polyester resin (1), 89 parts of isophorone diisocyanate and 500 parts of ethyl acetate are mixed and the mixture is heated at 100° C. for 5 hours to perform the reaction. Thus, a polyester prepolymer (1) having an isocyanate group is prepared. A ratio of free isocyanate group included in the polyester prepolymer (1) is 1.53% by weight.

Preparation of Master Batch

The following components are mixed using a HENSHEL MIXER.

| | |
|---|---|
| Carbon black (REGAL 400R from Cabot Corp.) | 40 parts |

-continued

| | |
|---|---|
| Polyester resin (RS-801 from Sanyo Chemical Industries Ltd., having an acid value of 10 mgKOH/g, Mw of 20000, and Tg of 64° C.) | 60 parts |
| Water | 30 parts |

The mixture is kneaded with a two-roll mill for 45 minutes at 130° C., and then pulverized into particles having a particle diameter of 1 mm using a pulverizer. Thus, a master batch (1) is prepared.

Example 1

Preparation of Colorant/wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over 1 hour.

Then 500 parts of the master batch (1) and 100 parts of ethyl acetate are added to the vessel, and the mixture is agitated for 1 hour to prepare a raw material dispersion (1).

Then 1500 parts of the raw material dispersion (1) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 655 parts of a 65% ethyl acetate solution of the polyester (P-1) prepared above is added thereto. The mixture is subjected to the dispersion treatment using the bead mill. The dispersion conditions are the same as those mentioned above except that the dispersion operation is performed once (i.e., one pass).

Thus, a colorant/wax dispersion (1) is prepared. Some ethyl acetate is added to the colorant/wax dispersion so that a solid content of the colorant/wax dispersion (1) is 50% at 130° C., 30 minutes.

Preparation of Water Phase 968 parts of ion-exchange water, 40 parts of an aqueous solution of a particulate resin (styrene/methacrylic acid/butyl acrylate/sodium salt of a sulfuric acid ester of ethylene oxide adduct of methacrylic acid copolymer, content of 25% by weight) serving as a dispersion stabilizer, 150 parts of an aqueous solution of a sodium salt of dodecyldiphenyletherdisulfonic acid (ELEMINOLMON-7 (trademark) from Sanyo Chemical Industries Ltd., solid content of 48.5%), and 98 parts of ethyl acetate are mixed. As a result, a water phase (1) is prepared.

Emulsification

Then the following components are mixed in a vessel.

| | |
|---|---|
| Colorant/wax dispersion (1) prepared above | 976 parts |
| Isophorone diamine | 2.6 parts |

The components are mixed for 1 minute using a mixer TK HOMOMIXER (trademark) from Tokushu Kika Kogyo K. K. at a revolution of 5,000 rpm.

Then 88 parts of the prepolymer (1) prepared above is added thereto. The components are mixed for 1 minute using a mixer TK HOMOMIXER (trademark) at a revolution of 5,000 rpm.

Then 1200 parts of the water phase (1) prepared above is added thereto. The mixture is agitated for 20 minutes with a mixer TK HOMOMIXER (trademark) at a revolution of from 8,000 to 13,000 rpm. As a result, an emulsion (1) is prepared.

Solvent Removal

The emulsion (1) is fed into a container equipped with a stirrer and a thermometer, and the emulsion is heated for 8 hours at 30° C. to remove the organic solvent (ethyl acetate) from the emulsion. Thus, a dispersion (1) is prepared.

Adherence of Particulate Resin

The dispersion (1) and the dispersion of the particulate vinyl copolymer resin (V-1) prepared above are mixed at a mixing ratio of 1/0.15 based on a solid content. The mixture is heated to 73° C. taking 30 minutes.

A mixture liquid of 100 parts of ion-exchange water and 100 parts of magnesium chloride hexahydrate is gradually added thereto and kept for 4 hours at 73° C. Then pH of the mixture is controlled to be 5 by adding hydrochloric acid. The mixture is heated to 80° C. for 2 hours, and then cooled down. Thus, a dispersion (1-2) is prepared.

Washing and Drying

One hundred (100) parts of the dispersion (1-2) is filtered under a reduced pressure.

The thus obtained wet cake is mixed with 100 parts of ion-exchange water and the mixture is agitated for 10 minutes with a TK HOMOMIXER at a revolution of 12,000 rpm, followed by filtering. Thus, a wet cake (1) is prepared.

The wet cake (1) is mixed with 900 parts of ion-exchange water and the mixture is agitated for 30 minutes with a TK HOMOMIXER at a revolution of 12,000 rpm with applying an ultrasonic wave, followed by filtering under a reduced pressure. This washing operation is repeated until an electric conductivity of the mixture (i.e., re-slurry liquid) is not greater than 10 μC/cm. Thus, a wet cake (2) is prepared.

A re-slurry liquid of the wet cake (2) is mixed with a 10% aqueous solution of hydrochloric acid so that pH of the re-slurry liquid is 4. The re-slurry liquid is agitated for 30 minutes with a stirrer, followed by filtering. Thus, a wet cake (3) is prepared.

The wet cake (3) is mixed with 100 parts of ion-exchange water and the mixture is agitated for 10 minutes with a TK HOMOMIXER at a revolution of 12,000 rpm, followed by filtering. This washing operation is repeated until an electric conductivity of the mixture (i.e., re-slurry liquid) is not greater than 10 μC/cm. Thus, a wet cake (4) is prepared.

The wet cake (4) is dried for 48 hours at 45° C. using a circulating air drier, followed by sieving with a screen having openings of 75 μm. Thus, mother toner particles (1) are prepared. The mother toner particles (1) had a volume average particle diameter (Dv) of 5.8 μm, a number average particle diameter (Dp) of 5.2 μm, a particle diameter distribution Dv/Dp of 1.12 and an average circularity of 0.973.

Then 100 parts of the mother toner particles (1) are mixed with 0.5 parts of a hydrophobized silica and 0.5 parts of a hydrophobized titanium oxide using HENSHEL MIXER. Thus, a toner (1) is prepared.

Example 2

Preparation of Colorant/wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over 1 hour. Then 500 parts of the master batch (1) and 10 parts of ethyl acetate are added to the vessel, and the mixture is agitated for 1 hour to prepare a raw material dispersion (2).

Then 1500 parts of the raw material dispersion (2) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 538 parts of a 65% ethyl acetate solution of the polyester (P-1) prepared above is added thereto. The mixture is subjected to the dispersion treatment using the bead mill. The dispersion conditions are the same as those mentioned above except that the dispersion operation is performed once (i.e., one pass).

Thus, a colorant/wax dispersion (2) is prepared. Some ethyl acetate is added to the colorant/wax dispersion so that a solid content of the colorant/wax dispersion (2) is 50% at 130° C., 30 minutes.

Emulsification

Then 976 parts of the colorant/wax dispersion (2) is agitated for 1 minute using a mixer TK HOMOMIXER (trademark) from Tokushu Kika Kogyo K. K. at a revolution of 5,000 rpm.

Then 1200 parts of the water phase (1) prepared above is added thereto. The mixture is agitated for 20 minutes with a mixer TK HOMOMIXER (trademark) at a revolution of from 8,000 to 13,000 rpm. As a result, an emulsion (2) is prepared.

Solvent Removal

The procedure for solvent removal in Example 1 is repeated except that the emulsion (1) is replaced with the emulsion (2). Thus, a dispersion (2) is prepared.

Adherence of Particulate Resin

The dispersion (2) and the dispersion of the particulate vinyl copolymer resin (V-1) prepared above are mixed at a mixing ratio of 1/0.3 based on a solid content. The mixture is heated to 73° C. taking 30 minutes.

A mixture liquid of 150 parts of ion-exchange water and 150 parts of magnesium chloride hexahydrate is gradually added thereto and kept for 6 hours at 73° C. Then pH of the mixture is controlled to be 5 by adding hydrochloric acid. The mixture is heated to 80° C. for 2 hours, and then cooled down. Thus, a dispersion (2-2) is prepared.

The procedure for preparation of the toner in Example 1 is repeated except the dispersion (1-2) is replaced with the dispersion (2-2). Thus, a toner (2) is prepared.

Example 3

Adherence of Particulate Resin

The dispersion (2) prepared in Example 2 and the dispersion of the particulate vinyl copolymer resin (V-1) prepared above are mixed at a mixing ratio of 1/0.2 based on a solid content. The mixture is heated to 73° C. taking 30 minutes.

A mixture liquid of 100 parts of ion-exchange water and 100 parts of magnesium chloride hexahydrate is gradually added thereto and kept for 5 hours at 73° C. Then pH of the mixture is controlled to be 5 by adding hydrochloric acid. The mixture is heated to 80° C. for 2 hours, and then cooled down. Thus, a dispersion (3-2) is prepared.

The procedure for preparation of the toner in Example 1 is repeated except the dispersion (1-2) is replaced with the dispersion (3-2). Thus, a toner (3) is prepared.

Example 4

Adherence of Particulate Resin

The dispersion (1) prepared in Example 1 and the dispersion of the particulate vinyl copolymer resin (V-2) prepared above are mixed at a mixing ratio of 1/0.1 based on a solid content. The mixture is heated to 73° C. taking 30 minutes.

A mixture liquid of 50 parts of ion-exchange water and 50 parts of magnesium chloride hexahydrate is gradually added thereto and kept for 3 hours at 73° C. Then pH of the mixture is controlled to be 5 by adding hydrochloric acid. The mixture is heated to 80° C. for 2 hours, and then cooled down. Thus, a dispersion (4-2) is prepared.

The procedure for preparation of the toner in Example 1 is repeated except the dispersion (1-2) is replaced with the dispersion (4-2). Thus, a toner (4) is prepared.

Example 5

The procedure for preparation of the toner in Example 2 is repeated except the polyester (P-1) is replaced with the polyester (P-2). Thus, a toner (5) is prepared.

Example 6

The procedure for preparation of the toner in Example 4 is repeated except the polyester (P-1) is replaced with the polyester (P-2), and the particulate vinyl copolymer resin (V-2) is replaced with the particulate vinyl copolymer resin (V-1). Thus, a toner (6) is prepared.

Example 7

The procedure for preparation of the toner in Example 3 is repeated except the polyester (P-1) is replaced with the polyester (P-2), and the particulate vinyl copolymer resin (V-1) is replaced with the particulate vinyl copolymer resin (V-2). Thus, a toner (7) is prepared.

Example 8

The procedure for preparation of the toner in Example 1 is repeated except the particulate vinyl copolymer resin (V-1) is replaced with the particulate vinyl copolymer resin (V-3). Thus, a toner (8) is prepared.

Comparative Example 1

Preparation of Colorant/wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over 1 hour. Then 500 parts of the master batch (1) and 250 parts of ethyl acetate are added to the vessel, and the mixture is agitated for 1 hour to prepare a raw material dispersion (R1).

Then 1300 parts of the raw material dispersion (R1) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 849 parts of a 65% ethyl acetate solution of the polyester (P-1) prepared above is added thereto. The mixture is subjected to the dispersion treatment using the bead mill. The dispersion conditions are the same as those mentioned above except that the dispersion operation is performed once (i.e., one pass).

Thus, a colorant/wax dispersion (R1) is prepared. Some ethyl acetate is added to the colorant/wax dispersion so that a solid content of the colorant/wax dispersion (R1) is 50% at 130° C., 30 minutes.

Emulsification

Then 976 parts of the colorant/wax dispersion (R1) is agitated for 1 minute using a mixer TK HOMOMIXER (trademark) from Tokushu Kika Kogyo K. K. at a revolution of 5,000 rpm.

Then 1200 parts of the water phase (1) prepared above is added thereto. The mixture is agitated for 20 minutes with a mixer TK HOMOMIXER (trademark) at a revolution of from 8,000 to 13,000 rpm. As a result, an emulsion (R1) is prepared.

Solvent Removal

The procedure for solvent removal in Example 1 is repeated except that the emulsion (1) is replaced with the emulsion (R1). Thus, a dispersion (R1) is prepared.

The dispersion (R1) is not subjected to the adherence of the particulate resin.

The procedure for preparation of the toner in Example 1 is repeated except the dispersion (1-2) is replaced with the dispersion (R1). Thus, a comparative toner (R1) is prepared.

Comparative Example 2

The procedure for preparation of the toner in Comparative Example 1 is repeated except the polyester (P-1) is replaced with the polyester (P-2). Thus, a comparative toner (R2) is prepared.

Comparative Example 3

Preparation of Colorant/wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over 1 hour. Then 500 parts of the master batch (1) and 100 parts of ethyl acetate are added to the vessel, and the mixture is agitated for 1 hour to prepare a raw material dispersion (R3).

Then 1500 parts of the raw material dispersion (R3) are subjected to a dispersion treatment using a bead mill (ULTRAVISCOMILL (trademark) from Aimex Co., Ltd.). The dispersing conditions are as follows.

Liquid feeding speed: 1 kg/hour
Peripheral speed of disc: 6 m/sec
Dispersion media: zirconia beads with a diameter of 0.5 mm
Filling factor of beads: 80% by volume
Repeat number of dispersing operation: 3 times (3 passes)

Then 826 parts of a 65% ethyl acetate solution of the polyester (P-1) prepared above is added thereto. The mixture is subjected to the dispersion treatment using the bead mill. The dispersion conditions are the same as those mentioned above except that the dispersion operation is performed once (i.e., one pass).

Thus, a colorant/wax dispersion (R3) is prepared. Some ethyl acetate is added to the colorant/wax dispersion so that a solid content of the colorant/wax dispersion (R3) is 50% at 130° C., 30 minutes.

Emulsification

Then the following components are mixed in a vessel.

| | |
|---|---|
| Colorant/wax dispersion (R3) prepared above | 976 parts |
| Isophorone diamine | 2.7 parts |

The components are mixed for 1 minute using a mixer TK HOMOMIXER (trademark) from Tokushu Kika Kogyo K. K. at a revolution of 5,000 rpm.

Then 90 parts of the prepolymer (1) prepared above is added thereto. The components are mixed for 1 minute using a mixer TK HOMOMIXER (trademark) at a revolution of 5,000 rpm.

Then 1200 parts of the water phase (1) prepared above is added thereto. The mixture is agitated for 20 minutes with a mixer TK HOMOMIXER (trademark) at a revolution of from 8,000 to 13,000 rpm. As a result, an emulsion (R3) is prepared.

Solvent Removal

The procedure for solvent removal in Example 1 is repeated except that the emulsion (1) is replaced with the emulsion (R3) Thus, a dispersion (R3) is prepared.

Heating

Then the dispersion (R3) is heated to 73° C. for 8 hours in order to accelerate the reaction between the prepolymer and the amine.

The dispersion (R3) is not subjected to the adherence of the particulate resin.

The procedure for preparation of the toner in Example 1 is repeated except the dispersion (1-2) is replaced with the dispersion (R3). Thus, a comparative toner (R3) is prepared.

Comparative Example 4

Preparation of Colorant Dispersion

Fifty (50) parts of carbon black (REGAL 400R from Cabot Corp.), 33 parts of an aqueous solution of a sodium salt of dodecyldiphenyletherdisulfonic acid (solid content of 48.5%), and 587 parts of ion-exchange water are mixed using TK HOMOMIXER. Thus, a colorant dispersion (R4) is prepared.

Preparation of Wax Dispersion

Fifty (50) parts of carnauba wax, 25 parts of an aqueous solution of a sodium salt of dodecyldiphenyletherdisulfonic acid (solid content of 48.5%), and 275 parts of ion-exchange water are mixed using TK HOMOMIXER. Then the mixture is subjected to a dispersion treatment using a bead mill (dispersion media: zirconia beads with a diameter of 0.5 mm). Thus, a wax dispersion (R4) is prepared.

Aggregation

The following components are fed in a vessel.

| | |
|---|---|
| Particulate vinyl copolymer resin (V-2) | 1600 parts |
| Colorant dispersion (R4) | 474 parts |
| Wax dispersion (R4) | 225 parts |
| Ion-exchange water | 2300 parts |

The mixture is agitated, and pH of the mixture is controlled to be 6 by adding an aqueous solution of sodium hydroxide. Then the mixture is heated to from 45 to 50° C., and an aqueous solution of sodium hydroxide is gradually added while observing an aggregation condition. When an average particle diameter of an aggregation particle is about 5.0 μm, 40 parts of an aqueous solution of a sodium salt of dodecyldiphenyletherdisulfonic acid (solid content of 48.5%) is added thereto. Further, pH of the mixture is controlled to be 5. Thus, a dispersion (R4) is prepared.

Adherence of Particulate Resin

The dispersion (R4) and the dispersion of the particulate vinyl copolymer resin (V-1) prepared above are mixed at a mixing ratio of 1/0.2 based on a solid content. The mixture is heated to 73° C. taking 30 minutes.

A mixture liquid of 100 parts of ion-exchange water and 100 parts of magnesium chloride hexahydrate is gradually added thereto and kept for 5 hours at 73° C. Then pH of the mixture is controlled to be 5 by adding hydrochloric acid. The mixture is heated to 80° C. for 2 hours, and then cooled down. Thus, a dispersion (R4-2) is prepared.

The procedure for preparation of the toner in Example 1 is repeated except the dispersion (1-2) is replaced with the dispersion (R4-2). Thus, a comparative toner (R4) is prepared.

Comparative Example 5

The procedure for preparation of the toner in Comparative Example 4 is repeated except the particulate vinyl copolymer resin (V-2) is replaced with the particulate vinyl copolymer resin (V-3). Thus, a comparative toner (R5) is prepared.

Comparative Example 6

Adherence of Particulate Resin

The dispersion (2) prepared in Example 2 and the dispersion of the particulate vinyl copolymer resin (V-1) prepared above are mixed at a mixing ratio of 1/0.02 based on a solid content. The mixture is heated to 73° C. taking 30 minutes.

A mixture liquid of 10 parts of ion-exchange water and 10 parts of magnesium chloride hexahydrate is gradually added thereto and kept for 2 hours at 73° C. Then pH of the mixture is controlled to be 5 by adding hydrochloric acid. The mixture is heated to 80° C. for 2 hours, and then cooled down. Thus, a dispersion (R6-2) is prepared.

The procedure for preparation of the toner in Example 1 is repeated except the dispersion (1-2) is replaced with the dispersion (R6-2). Thus, a comparative toner (R6) is prepared.

Comparative Example 7

Adherence of Particulate Resin

The dispersion (2) prepared in Example 2 and the dispersion of the particulate vinyl copolymer resin (V-1) prepared above are mixed at a mixing ratio of 1/0.6 based on a solid content. The mixture is heated to 73° C. taking 30 minutes.

A mixture liquid of 200 parts of ion-exchange water and 200 parts of magnesium chloride hexahydrate is gradually added thereto and kept for 8 hours at 73° C. Then pH of the mixture is controlled to be 5 by adding hydrochloric acid. The mixture is heated to 80° C. for 2 hours, and then cooled down. Thus, a dispersion (R7-2) is prepared.

The procedure for preparation of the toner in Example 1 is repeated except the dispersion (1-2) is replaced with the dispersion (R7-2). Thus, a comparative toner (R7) is prepared.

The properties of each of the thus prepared toners are shown in Table 2-1, and the results of the evaluations of the toners are shown in Table 2-2.

TABLE 2-1

| | Resin composition | | | Toner particle diameter | | | Toner shape |
|---|---|---|---|---|---|---|---|
| | Core[1)] | Shell | Ratio (Core/Shell) | Dv (μm) | Dn (μm) | Dv/Dn | Average circularity |
| Ex. 1 | P-1 + HP | V-1 | 1/0.15 | 5.8 | 5.2 | 1.12 | 0.973 |
| Ex. 2 | P-1 | V-1 | 1/0.3 | 5.9 | 5.0 | 1.18 | 0.972 |
| Ex. 3 | P-1 | V-1 | 1/0.2 | 5.6 | 4.9 | 1.14 | 0.970 |
| Ex. 4 | P-1 + HP | V-2 | 1/0.1 | 5.6 | 5.1 | 1.10 | 0.971 |
| Ex. 5 | P-2 | V-1 | 1/0.3 | 5.8 | 5.1 | 1.14 | 0.973 |
| Ex. 6 | P-2 + HP | V-1 | 1/0.1 | 5.5 | 5.0 | 1.10 | 0.975 |
| Ex. 7 | P-2 | V-2 | 1/0.2 | 6.1 | 5.4 | 1.13 | 0.968 |
| Ex. 8 | P-1 + HP | V-3 | 1/0.15 | 5.9 | 5.1 | 1.16 | 0.971 |
| Comp. Ex. 1 | P-1 | — | — | 5.6 | 4.9 | 1.14 | 0.975 |
| Comp. Ex. 2 | P-2 | — | — | 5.9 | 5.1 | 1.16 | 0.975 |
| Comp. Ex. 3 | P-1 + HP | — | — | 5.9 | 5.3 | 1.11 | 0.971 |
| Comp. Ex. 4 | V-2 | V-1 | 1/0.2 | 5.6 | 5.0 | 1.12 | 0.968 |
| Comp. Ex. 5 | V-3 | V-1 | 1/0.2 | 5.8 | 5.2 | 1.12 | 0.968 |
| Comp. Ex. 6 | P-1 | V-1 | 1/0.02 | 5.9 | 5.1 | 1.16 | 0.972 |
| Comp. Ex. 7 | P-1 | V-1 | 1/0.6 | 6.0 | 5.3 | 1.13 | 0.973 |

Core[1)]: "HP" means the reactant of the prepolymer and the amine.

TABLE 2-2

| | Fixability | Toner filming | Durability | Thermostable preservability |
|---|---|---|---|---|
| Ex. 1 | ○ | ○ | ○ | ◎ |
| Ex. 2 | ○ | ○ | ○ | ◎ |
| Ex. 3 | ○ | ○ | ○ | ◎ |
| Ex. 4 | ○ | ○ | ○ | ◎ |
| Ex. 5 | ○ | ○ | ○ | ◎ |
| Ex. 6 | ○ | ○ | ○ | ◎ |
| Ex. 7 | ○ | ○ | ○ | ◎ |
| Ex. 8 | ○ | ○ | ○ | ◎ |
| Comp. Ex. 1 | X | X | X | X |
| Comp. Ex. 2 | Δ | X | Δ | X |
| Comp. Ex. 3 | Δ | Δ | ○ | ◎ |
| Comp. Ex. 4 | Δ | ○ | Δ | ○ |
| Comp. Ex. 5 | X | ○ | Δ | ○ |
| Comp. Ex. 6 | Δ | Δ | Δ | X |
| Comp. Ex. 7 | X | ○ | Δ | ○ |

It is clear from Table 2-1 and Table 2-2 that the toners of the present invention show good results in all evaluation. In contrast, toners of Comparative Examples 1, 2 and 3, which have no shell, show bad results in fixability, toner film, durability, and thermostable preservability. In addition, toners of Comparative Examples 4 and 5, which do not include polyester resin, cannot have both good fixability and thermostable preservability at the same time, and have poor durability. Moreover, toners of Comparative Examples 6 and 7, in which core/shell ratios are not appropriate, also cannot have both good fixability and thermostable preservability at the same time, and have poor durability.

Example 9

Adherence of Particulate Resin

The dispersion (1) prepared in Example 1 (hereinafter referred to dispersion (9)) and the dispersion of the particulate vinyl copolymer resin (V-1) prepared above are mixed at a mixing ratio of 0.9/0.1 based on a solid content. The mixture is heated to 73° C. taking 30 minutes.

A mixture liquid of 10 parts of ion-exchange water and 10 parts of magnesium chloride hexahydrate is gradually added thereto and kept at 73° C. until almost all of the particulate resin is adhered. Then pH of the mixture is controlled to be 5 by adding hydrochloric acid. The mixture is heated to 80° C. for 2 hours, and then cooled down. Thus, a dispersion (9-2) is prepared.

The procedure for washing and drying of the dispersion in Example 1 is repeated except the dispersion (1-2) is replaced with the dispersion (9-2). Thus, mother toner particles (9) are prepared. The mother toner particles (9) had a volume average particle diameter (Dv) of 5.7 μm, a number average particle diameter (Dp) of 5.1 μm, a particle diameter distribution Dv/Dp of 1.12 and an average circularity of 0.972.

Then 100 parts of the mother toner particles (9) are mixed with 0.5 parts of a hydrophobized silica and 0.5 parts of a hydrophobized titanium oxide using HENSHEL MIXER. Thus, a toner (9) is prepared.

Example 10

The procedure for preparation of the toner in Example 9 is repeated except "a mixture liquid of 10 parts of ion-exchange water and 10 parts of magnesium chloride hexahydrate" is replaced with "a mixture liquid of 10 parts of ion-exchange water and 10 parts of calcium chloride." Thus, a toner (10) is prepared.

Example 11

The procedure for preparation of the toner in Example 9 is repeated except "a mixture liquid of 10 parts of ion-exchange water and 10 parts of magnesium chloride hexahydrate" is replaced with "3 parts of poly aluminum chloride." Thus, a toner (11) is prepared.

Example 12

Adherence of Particulate Resin

The dispersion (9) prepared in Example 9 and the dispersion of the particulate vinyl copolymer resin (V-1) prepared above are mixed at a mixing ratio of 0.8/0.2 based on a solid content. The mixture is heated to 73° C. taking 30 minutes.

A mixture liquid of 20 parts of ion-exchange water and 20 parts of magnesium chloride hexahydrate is gradually added thereto and kept for 6 hours at 73° C. Then pH of the mixture is controlled to be 5 by adding hydrochloric acid. The mixture is heated to 80° C. for 2 hours, and then cooled down. Thus, a dispersion (12-2) is prepared.

The procedure for preparation of the toner in Example 9 is repeated except the dispersion (9-2) is replaced with the dispersion (12-2). Thus, a comparative toner (12) is prepared.

Example 13

The procedure for preparation of the toner in Example 12 is repeated except "a mixture liquid of 20 parts of ion-exchange water and 20 parts of magnesium chloride hexahydrate" is replaced with "a mixture liquid of 20 parts of ion-exchange water and 20 parts of calcium chloride." Thus, a toner (13) is prepared.

Example 14

The procedure for preparation of the toner in Example 12 is repeated except "a mixture liquid of 20 parts of ion-exchange water and 20 parts of magnesium chloride hexahydrate" is replaced with "6 parts of poly aluminum chloride." Thus, a toner (14) is prepared.

Comparative Example 8

The procedure for preparation of the toner in Comparative Example 1 is repeated. Thus, a comparative toner (R8) is prepared.

Comparative Example 9

The procedure for preparation of the toner in Comparative Example 3 is repeated. Thus, a comparative toner (R9) is prepared.

Comparative Example 10

The procedure for preparation of the toner in Example 9 is repeated except "a mixture liquid of 10 parts of ion-exchange water and 10 parts of magnesium chloride hexahydrate" is replaced with "a mixture liquid of 100 parts of ion-exchange water and 100 parts of magnesium chloride hexahydrate." Thus, a comparative toner (R10) is prepared.

Comparative Example 11

The procedure for preparation of the toner in Example 9 is repeated except "a mixture liquid of 10 parts of ion-exchange water and 10 parts of magnesium chloride hexahydrate" is replaced with "a mixture liquid of 100 parts of ion-exchange water and 100 parts of calcium chloride." Thus, a comparative toner (R11) is prepared.

Comparative Example 12

The procedure for preparation of the toner in Example 9 is repeated except "a mixture liquid of 10 parts of ion-exchange water and 10 parts of magnesium chloride hexahydrate" is replaced with "30 parts of poly aluminum chloride." Thus, a comparative toner (R12) is prepared.

Comparative Example 13

Preparation of Colorant Dispersion

Fifty (50) parts of carbon black (REGAL 400R from Cabot Corp.), 33 parts of an aqueous solution of a sodium salt of dodecyldiphenyletherdisulfonic acid (solid content of 48.5%), and 587 parts of ion-exchange water are mixed using TK HOMOMIXER. Thus, a colorant dispersion (R13) is prepared.

Preparation of Wax Dispersion

Fifty (50) parts of carnauba wax, 25 parts of an aqueous solution of a sodium salt of dodecyldiphenyletherdisulfonic acid (solid content of 48.5%), and 275 parts of ion-exchange water are mixed using TK HOMOMIXER. Then the mixture is subjected to a dispersion treatment using a bead mill (dispersion media: zirconia beads with a diameter of 0.5 mm). Thus, a wax dispersion (R13) is prepared.

Aggregation

The following components are fed in a vessel.

| | |
|---|---|
| Particulate vinyl copolymer resin (V-2) | 1600 parts |
| Colorant dispersion (R13) | 474 parts |
| Wax dispersion (R13) | 225 parts |
| Ion-exchange water | 2300 parts |

The mixture is agitated, and pH of the mixture is controlled to be 6 by adding an aqueous solution of sodium hydroxide. A mixture liquid of 100 parts of ion-exchange water and 100 parts of magnesium chloride hexahydrate is added thereto. Then the mixture is heated to from 45 to 50° C., and an aqueous solution of sodium hydroxide is gradually added while observing an aggregation condition. When an average particle diameter of an aggregation particle is about 5.5 μm, 40 parts of an aqueous solution of a sodium salt of dodecyldiphenyletherdisulfonic acid (solid content of 48.5%) is added thereto. Further, pH of the mixture is controlled to be 5. Thus, a dispersion (R13) is prepared.

Adherence of Particulate Resin

The dispersion (R13) and the dispersion of the particulate vinyl copolymer resin (V-1) prepared above are mixed at a mixing ratio of 0.9/0.1 based on a solid content. The mixture is heated to 73° C. taking 30 minutes.

A mixture liquid of 10 parts of ion-exchange water and 10 parts of magnesium chloride hexahydrate is gradually added thereto and kept at 73° C. until almost all of the particulate resin is adhered. Then pH of the mixture is controlled to be 5 by adding hydrochloric acid. The mixture is heated to 80° C. for 2 hours, and then cooled down. Thus, a dispersion (R13-2) is prepared.

The procedure for preparation of the toner in Example 9 is repeated except the dispersion (9-2) is replaced with the dispersion (R13-2). Thus, a comparative toner (R13) is prepared.

Comparative Example 14

The procedure for aggregation process in Comparative Example 13 is repeated except "a mixture liquid of 100 parts of ion-exchange water and 100 parts of magnesium chloride hexahydrate" is replaced with "a mixture liquid of 100 parts of ion-exchange water and 100 parts of calcium chloride."

In addition, the procedure for adherence of the particulate resin in Comparative Example 13 is repeated except "a mixture liquid of 10 parts of ion-exchange water and 10 parts of magnesium chloride hexahydrate" is replaced with "a mixture liquid of 10 parts of ion-exchange water and 10 parts of calcium chloride."

Thus, a comparative toner (R14) is prepared.

Comparative Example 15

The procedure for aggregation process in Comparative Example 13 is repeated except "a mixture liquid of 100 parts of ion-exchange water and 100 parts of magnesium chloride hexahydrate" is replaced with "30 parts of poly aluminum chloride."

In addition, the procedure for adherence of the particulate resin in Comparative Example 13 is repeated except "a mixture liquid of 10 parts of ion-exchange water and 10 parts of magnesium chloride hexahydrate" is replaced with "3 parts of poly aluminum chloride."

Thus, a comparative toner (R15) is prepared.

The properties of each of the thus prepared toners are shown in Table 3-1, and the results of the evaluations of the toners are shown in Table 3-2.

TABLE 3-1

| | Resin composition | | | Toner particle diameter | | | Toner shape | Fluorescent X-ray intensity[2)] (Kcps) | | |
|---|---|---|---|---|---|---|---|---|---|---|
| | Core[1)] | Shell | Ratio (Core/Shell) | Dv (μm) | Dn (μm) | Dv/Dn | Average circularity | Mg | Ca | Al |
| Ex. 9 | P-1 + HP | V-1 | 0.9/0.1 | 5.7 | 5.1 | 1.12 | 0.972 | 5 | ND | ND |
| Ex. 10 | P-1 + HP | V-1 | 0.9/0.1 | 5.6 | 5.0 | 1.12 | 0.971 | ND | 140 | ND |
| Ex. 11 | P-1 + HP | V-1 | 0.9/0.1 | 6.1 | 5.3 | 1.15 | 0.970 | ND | ND | 12 |
| Ex. 12 | P-1 + HP | V-1 | 0.8/0.2 | 5.5 | 4.9 | 1.12 | 0.974 | 12 | ND | ND |
| Ex. 13 | P-1 + HP | V-1 | 0.8/0.2 | 5.9 | 5.2 | 1.13 | 0.973 | ND | 300 | ND |
| Ex. 14 | P-1 + HP | V-1 | 0.8/0.2 | 5.7 | 5.1 | 1.12 | 0.971 | ND | ND | 21 |
| Comp. Ex. 8 | P-1 | — | — | 5.6 | 5.0 | 1.12 | 0.974 | ND | ND | ND |
| Comp. Ex. 9 | P-1 + HP | — | — | 5.9 | 5.3 | 1.11 | 0.971 | ND | ND | ND |
| Comp. Ex. 10 | P-1 + HP | V-1 | 0.9/0.1 | 6.1 | 5.4 | 1.13 | 0.970 | 45 | ND | ND |
| Comp. Ex. 11 | P-1 + HP | V-1 | 0.9/0.1 | 5.8 | 5.1 | 1.14 | 0.971 | ND | 780 | ND |
| Comp. Ex. 12 | P-1 + HP | V-1 | 0.9/0.1 | 5.7 | 4.9 | 1.16 | 0.971 | ND | ND | 52 |
| Comp. Ex. 13 | V-2 | V-1 | 0.9/0.1 | 5.9 | 5.1 | 1.16 | 0.969 | 58 | ND | ND |
| Comp. Ex. 14 | V-2 | V-1 | 0.9/0.1 | 5.8 | 5.1 | 1.14 | 0.970 | ND | 910 | ND |
| Comp. Ex. 15 | V-2 | V-1 | 0.9/0.1 | 5.8 | 5.0 | 1.16 | 0.971 | ND | ND | 48 |

Core[1)]: "HP" means the reactant of the prepolymer and the amine.
Fluorescent X-ray intensity[2)]: "ND" means "not detectable."

TABLE 3-2

| | Fixability | Toner filming | Durability | Thermostable preservability | Environmental resistance |
|---|---|---|---|---|---|
| Ex. 9 | ○ | ○ | ○ | ◎ | ○ |
| Ex. 10 | ○ | ○ | ○ | ◎ | ○ |
| Ex. 11 | ○ | ○ | ○ | ◎ | ○ |
| Ex. 12 | ○ | ○ | ○ | ◎ | ○ |
| Ex. 13 | ○ | ○ | ○ | ◎ | ○ |
| Ex. 14 | ○ | ○ | ○ | ◎ | ○ |
| Comp. Ex. 8 | X | X | X | X | ○ |
| Comp. Ex. 9 | Δ | Δ | ○ | ◎ | ○ |
| Comp. Ex. 10 | ○ | ○ | ○ | ◎ | X |
| Comp. Ex. 11 | ○ | ○ | ○ | ◎ | X |
| Comp. Ex. 12 | ○ | ○ | ○ | ◎ | Δ |
| Comp. Ex. 13 | Δ | ○ | Δ | ○ | X |
| Comp. Ex. 14 | X | ○ | Δ | ○ | X |
| Comp. Ex. 15 | Δ | ○ | Δ | Δ | Δ |

It is clear from Table 3-1 and Table 3-2 that the toners of the present invention show good results in all evaluation. In contrast, toners of Comparative Examples 8 and 9, which have no shell, show bad results in fixability, toner film, durability, and thermostable preservability. In addition, toners of Comparative Examples 13, 14 and 15, which do not include polyester resin, cannot have both good fixability and thermostable preservability at the same time, and have poor durability. Moreover, toners of Comparative Examples 10 to 15, which show strong fluorescent X-ray intensity of metals (Mg, Ca and Al), have poor environmental resistance.

Example 15

Preparation of Colorant/wax Dispersion

In a reaction vessel equipped with a stirrer and a thermometer, 378 parts of the polyester (P-3), 145 parts of a carnauba wax, and 947 parts of ethyl acetate are mixed and the mixture is heated to 80° C. while agitated. After being heated at 80° C. for 5hours, the mixture is cooled to 30 ° C. over 1 hour. Then 500 parts of the master batch (1) and 500 parts of ethyl acetate are added to the vessel, and the mixture is agitated for 1 hour to prepare a raw material dispersion (15).

Then 1324 parts of the raw material dispersion (15) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the polyester (P-3) prepared above is added thereto. The mixture is subjected to the dispersion treatment using the bead mill. The dispersion conditions are the same as those mentioned above except that the dispersion operation is performed once (i.e., one pass).

Thus, a colorant/wax dispersion (15) is prepared. Some ethyl acetate is added to the colorant/wax dispersion so that a solid content of the colorant/wax dispersion (15) is 50% at 130° C., 30 minutes.

Preparation of Water Phase 953 parts of ion-exchange water, 88 parts of an aqueous solution of a particulate vinyl resin (styrene/methacrylic acid/butyl acrylate/sodium salt of a sulfuric acid ester of ethylene oxide adduct of methacrylic acid copolymer, content of 25% by weight) serving as a dispersion stabilizer, 90 parts of an aqueous solution of a sodium salt of dodecyldiphenyletherdisulfonic acid (ELEMINOL MON-7 (trademark) from Sanyo Chemical Industries Ltd., solid content of 48.5%), and 113 parts of ethyl acetate aremixed. Asaresult, a water phase (15) is prepared.

Emulsification

Then the following components are mixed in a vessel.

| | |
|---|---|
| Colorant/wax dispersion (15) prepared above | 976 parts |
| Isophorone diamine | 6.0 parts |

The components are mixed for 1 minute using a mixer TK HOMOMIXER (trademark) from Tokushu Kika Kogyo K. K. at a revolution of 5,000 rpm.

Then 137 parts of the prepolymer (1) prepared above is added thereto. The components are mixed for 1 minute using a mixer TK HOMOMIXER (trademark) at a revolution of 5,000 rpm.

Then 1200 parts of the water phase (15) prepared above is added thereto. The mixture is agitated for 20 minutes with a mixer TK HOMOMIXER (trademark) at a revolution of 13,000 rpm. As a result, an emulsion (15) is prepared.

Adherence of Particulate Resin

The dispersion (15) and the dispersion of the particulate vinyl copolymer resin (V-4) prepared above are mixed at a mixing ratio of 90/10 based on a solid content. The mixture is agitated for 30 minutes.

A part of the mixture is subjected to a centrifugal separation in order to check that the supernatant liquid is clear. (i.e., the adherence of the particulate resin is well performed.)

Then pH of the mixture is controlled to be 5 by adding hydrochloric acid. The mixture is heated to 70° C. for 2 hours, and then cooled down. Thus, an emulsion (15-2) is prepared.

Solvent Removal

The emulsion (15-2) is fed into a container equipped with a stirrer and a thermometer, and the emulsion is heated for 8 hours at 30° C. to remove the organic solvent (ethyl acetate) from the emulsion. Thus, a dispersion (15) is prepared.

Washing and Drying

The procedure for washing and drying of the dispersion in Example 1 is repeated except the dispersion (1-2) is replaced with the dispersion (15). Thus, mother toner particles (15) are prepared. The mother toner particles (15) had a volume average particle diameter (Dv) of 5.8 μm, a number average particle diameter (Dp) of 5.2 μm, a particle diameter distribution Dv/Dp of 1.12 and an average circularity of 0.97.

Then 100 parts of the mother toner particles (15) are mixed with 0.5 parts of a hydrophobized silica and 0.5 parts of a hydrophobized titanium oxide using HENSHEL MIXER. Thus, a toner (15) is prepared.

Examples 16-21, Comparative Examples 16-20

The procedure for preparation of the toner in Example 15 is repeated except polyester resins, particulate vinyl copolymer resins, weight ratios of prepolymer and isophorone diamine are changed as appropriate. Thus, toners (16) to (21) and comparative toners (16) to (20) are prepared.

The properties of each of the thus prepared toners are shown in Table 4-1, and the results of the evaluations of the toners are shown in Table 4-2.

TABLE 4-1

| | Resin composition | | | Toner particle diameter | | | Toner shape |
|---|---|---|---|---|---|---|---|
| | Core[1)] | Shell | Ratio (Core/Shell) | Dv (μm) | Dn (μm) | Dv/Dn | Average circularity |
| Ex. 15 | P-3 + HP | V-3 | 0.9/0.1 | 5.8 | 5.2 | 1.12 | 0.970 |
| Ex. 16 | P-3 | V-3 | 0.8/0.2 | 5.9 | 5.2 | 1.13 | 0.972 |
| Ex. 17 | P-3 + HP | V-4 | 0.93/0.07 | 5.6 | 5.0 | 1.12 | 0.967 |
| Ex. 18 | P-4 | V-3 | 0.8/0.2 | 5.8 | 5.3 | 1.09 | 0.973 |
| Ex. 19 | P-4 + HP | V-3 | 0.9/0.1 | 5.5 | 5.0 | 1.10 | 0.975 |
| Ex. 20 | P-4 | V-4 | 0.85/0.15 | 5.8 | 5.2 | 1.12 | 0.968 |
| Ex. 21 | P-3 + HP | V-3 + V-4 | 0.85/0.15 | 5.9 | 5.3 | 1.11 | 0.971 |
| Comp. Ex. 16 | P-3 | — | — | 5.5 | 4.9 | 1.12 | 0.975 |
| Comp. Ex. 17 | P-4 | — | — | 5.7 | 5.1 | 1.12 | 0.975 |

TABLE 4-1-continued

| | Resin composition | | | Toner particle diameter | | | Toner shape |
|---|---|---|---|---|---|---|---|
| | Core[1)] | Shell | Ratio (Core/Shell) | Dv (μm) | Dn (μm) | Dv/Dn | Average circularity |
| Comp. Ex. 18 | P-3 + HP | — | — | 5.8 | 5.3 | 1.09 | 0.971 |
| Comp. Ex. 19 | P-3 | V-3 | 0.98/0.02 | 5.7 | 5.1 | 1.12 | 0.965 |
| Comp. Ex. 20 | P-3 | V-3 + V-4 | 0.6/0.4 | 5.9 | 5.3 | 1.11 | 0.973 |

Core[1)]: "HP" means the reactant of the prepolymer and the amine.

TABLE 4-2

| | Fixability | Toner filming | Durability | Thermostable preservability |
|---|---|---|---|---|
| Ex. 15 | ○ | ○ | ○ | ◎ |
| Ex. 16 | ○ | ○ | ○ | ◎ |
| Ex. 17 | ○ | ○ | ○ | ◎ |
| Ex. 18 | ○ | ○ | ○ | ◎ |
| Ex. 19 | ○ | ○ | ○ | ◎ |
| Ex. 20 | ○ | ○ | ○ | ◎ |
| Ex. 21 | ○ | ○ | ○ | ◎ |
| Comp. Ex. 16 | X | X | X | X |
| Comp. Ex. 17 | Δ | X | Δ | X |
| Comp. Ex. 18 | Δ | Δ | ○ | ◎ |
| Comp. Ex. 19 | Δ | Δ | Δ | Δ |
| Comp. Ex. 20 | Δ | ○ | Δ | ○ |

It is clear from Table 4-1 and Table 4-2 that the toners of the present invention show good results in all evaluation. In contrast, toners of Comparative Examples 16, 17 and 18, which have no shell, show bad results in fixability, toner film, durability, and thermostable preservability. In addition, toners of comparative Examples 19 and 20, in which core/shell ratios are not appropriate, cannot have both good fixability and thermostable preservability at the same time, and have poor durability.

This document claims priority and contains subject matter related to Japanese Patent Applications Nos. 2005-069234 and 2005-269690, filed on Mar. 11, 2005, and Sep. 16, 2005, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a core comprising a colorant, a release agent and a binder resin (A); and a shell comprising a binder resin (B), which is located overlying the core, wherein the binder resin (A) comprises a resin having a polyester skeleton, the binder resin (B) comprises a vinyl copolymer resin, and a weight ratio of the shell to the core is from 0.05 to 0.5, and wherein the toner has a volume average particle diameter of from 3 to 8 μm;

wherein the shell comprising the binder resin (B) is formed by aggregating a particulate vinyl copolymer resin using an aggregation agent; and wherein the aggregation agent comprises $Mg^{2+}$, and the toner has a fluorescent X-ray intensity of a peak specific to a Mg-Kα X-ray of from 3 to 30 Kcps.

2. The toner according to claim 1, wherein the binder resin (A) comprises a polyester resin.

3. The toner according to claim 1, wherein the toner is a non-magnetic toner.

4. The toner according to claim 1, wherein the toner satisfies the following relationships:

$$RA(P)\times 0.5>PB(P) \text{ and } RA(W)\times 0.5>PB(W),$$

wherein RA(P) represents a weight ratio of the colorant included in the core to the core, RA(W) represents a weight ratio of the release agent included in the core to the core, RB(P) represents a weight ratio of the colorant included in the shell to the shell, RB(W) represents a weight ratio of the release agent included in the shell to the shell.

5. The toner according to claim 1, wherein the shell comprising the binder resin (B) is formed by one of a method in which a particulate vinyl copolymer resin is aggregated on the core, and a method in which a particulate vinyl copolymer resin is fused on the core.

6. The toner according to claim 1, wherein the binder resin (B) has a weight average molecular weight of not greater than 50,000, and a glass transition temperature of from 40 to 80° C.

7. The toner according to claim 1, wherein the binder resin (A) comprises a modified polyester resin comprising a group selected from the group consisting of urethane groups and urea groups.

8. The toner according to claim 1, wherein the binder resin (A) comprises a modified polyester resin formed by subjecting a polyester comprising an isocyanate group at its ends to an elongation reaction and a crosslinking reaction using an amine.

9. The toner according to claim 1, wherein the toner comprises a charge controlling agent.

10. A toner manufacturing method comprising:

dissolving or dispersing at least a resin having a polyester skeleton, a colorant and a release agent in an organic solvent to prepare a core constituent mixture liquid;

dispersing the core constituent mixture liquid in an aqueous medium to prepare a first dispersion comprising core particles; and adding a second dispersion comprising a particulate vinyl copolymer resin to the first dispersion to adhere the particulate vinyl copolymer resin to the core particles.

11. The toner manufacturing method according to claim 10, wherein the second dispersion adding step comprises:

adding a second dispersion comprising a particulate vinyl copolymer resin and a metal salt to the first dispersion.

12. The toner manufacturing method according to claim 10, further comprising:

removing the organic solvent from the first dispersion before adding the second dispersion to the first dispersion.

13. The toner manufacturing method according to claim 12, further comprising:

heating the mixture to a temperature of not less than a glass transition temperature of the particulate vinyl copolymer resin after adding the second dispersion to the first dispersion.

14. The toner manufacturing method according to claim 12, further comprising:

heating the mixture to a temperature such that the particulate vinyl copolymer resin is fused on the core material after adding the second dispersion to the first dispersion.

15. The toner manufacturing method according to claim 10, wherein the second dispersion adding step comprises:

adding a second dispersion comprising a particulate vinyl copolymer resin to the first dispersion while the organic solvent is included in the first dispersion.

16. The toner manufacturing method according to claim 15, wherein a weight ratio of the particulate vinyl copolymer resin to the core particle on a solid basis is from 3/97 to 30/70.

17. The toner manufacturing method according to claim 15, further comprising:

removing the organic solvent from the mixture after the particulate vinyl copolymer resin is adhered to the core particles; and then heating the mixture to fuse the particulate vinyl copolymer resin.

18. The toner manufacturing method according to claim 15, further comprising:

removing the organic solvent from the mixture after the particulate vinyl copolymer resin is adhered to the core particles;

then further adding the particulate vinyl copolymer resin to the mixture; and then heating the mixture to adhere the particulate vinyl copolymer resin to the core particles.

19. The toner manufacturing method according to claim 18, wherein heating is performed such that the particulate copolymer resin is fused on the core particles.

20. The toner manufacturing method according to claim 10, wherein the aqueous medium comprises a particulate resin.

21. An image forming apparatus comprising:

an image bearing member configured to bear an electrostatic latent image;

a charging device configured to charge the image bearing member;

a writing device configured to irradiate the charged image bearing member with a light beam to form the electrostatic latent image;

a developing device configured to develop the electrostatic latent image with a developer comprising a toner to form a toner image on the image bearing member;

a transferring device configured to transfer the toner image onto a recording material;

a cleaning device configured to clean the surface of the image bearing member; and a fixing device configured to fix the toner image on the recording material, wherein the toner is the toner according to claim 1.

22. The image forming apparatus according to claim 21, wherein the fixing device comprises a roller as a fixing member.

23. The image forming apparatus according to claim 21, wherein the fixing device comprises a fixing member, wherein an oil is not applied to the fixing member.

24. A process cartridge for use in the image forming apparatus according to claim 21, comprising:

a photoreceptor configured to bear an electrostatic latent image; and a developing device configured to develop the electrostatic latent image with a developer comprising a toner to form a toner image on the photoreceptor.

25. A toner, comprising:

a core comprising a colorant, a release agent and a binder resin (A); and a shell comprising a binder resin (B), which is located overlying the core, wherein the binder resin (A) comprises a resin having a polyester skeleton, the binder resin (B) comprises a vinyl copolymer resin, and a weight ratio of the shell to the core is from 0.05 to 0.5, and wherein the toner has a volume average particle diameter of from 3 to 8 μm;

wherein the shell comprising the binder resin (B) is formed by aggregating a particulate vinyl copolymer resin using an aggregation agent;

wherein the aggregation agent comprises $Ca^{2+}$, and the toner has a fluorescent X-ray intensity of a peak specific to a Ca-Kα X-ray of from 45 to 500 Kcps.

26. A toner, comprising:

a core comprising a colorant, a release agent and a binder resin (A); and a shell comprising a binder resin (B), which is located overlying the core, wherein the binder resin (A) comprises a resin having a polyester skeleton, the binder resin (B) comprises a vinyl copolymer resin, and a weight ratio of the shell to the core is from 0.05 to 0.5, and wherein the toner has a volume average particle diameter of from 3 to 8 μm;

wherein the shell comprising the binder resin (B) is formed by aggregating a particulate vinyl copolymer resin using an aggregation agent;

wherein the aggregation agent comprises $Al^{3+}$, and the toner has a fluorescent X-ray intensity of a peak specific to a Al-Kα X-ray of from 3 to 30 Kcps.

* * * * *